US005588602A

United States Patent [19]

Uno et al.

[11] Patent Number: 5,588,602

[45] Date of Patent: Dec. 31, 1996

[54] PACKAGE CHANGING SYSTEM FOR SUPPLYING AND DISCHARGING LOADED AND EMPTY PACKAGES TO AND FROM A MACHINE FRAME

[75] Inventors: Toshiyuki Uno, Kusatsu; Yasuhiko Kubota, Kyoto, both of Japan

[73] Assignee: Murata Kikai Kabushiki Kaisha, Kyoto, Japan

[21] Appl. No.: 195,477

[22] Filed: Feb. 14, 1994

[30] Foreign Application Priority Data

Feb. 16, 1993 [JP] Japan ..... 5-051492
Jul. 13, 1993 [JP] Japan ..... 5-172888

[51] Int. Cl.[6] ..... D01H 9/10; D01H 9/14

[52] U.S. Cl. ..... 242/35.50 A; 57/90; 57/266; 57/274; 198/465.4; 242/35.50 R

[58] Field of Search ..... 198/465.4, 687.1; 242/35.5 A, 35.5 R; 57/281, 90, 266, 274, 273, 275

[56] References Cited

FOREIGN PATENT DOCUMENTS 2257429 11/1987 Japan ..... 57/281

*Primary Examiner*—William Stryjewski
*Attorney, Agent, or Firm*—Armstrong, Westerman, Hattori, McLeland & Naughton

[57] ABSTRACT

A package changing system for supplying or discharging loaded bobbins or packages to or empty bobbin or packages from a machine frame, the package changing system comprising a conveyance unit for supplying and discharging the bobbins or packages and including a first rail for moving the conveyance unit in a horizontal direction relative to the machine frame and second guide rails moving together with the conveyance unit in a vertical direction relative to the machine frame, the first and second guide rails moving the conveyance unit to predetermined positions on the machine frame.

11 Claims, 14 Drawing Sheets

PACKAGE CHANGING SYSTEM FOR SUPPLYING AND DISCHARGING LOADED AND EMPTY PACKAGES TO AND FROM A MACHINE FRAME

BACKGROUND OF THE INVENTION

1. Field of the Invention

The present invention relates to a package changing system capable of changing packages efficiently with respect to a machine frame on which a large number of spindles for the change of empty and full-loaded packages are arranged in rows.

2. Prior Art

For example, in a double twister (two for one twister) for filament, a cheese-shaped package is wound back into a pirn-shaped package by means of a pirn winder, then the pirn is twisted twice and again wound into a cheese-shaped package. The change of package in such a double twister for filament is performed in the following order, ①-⑤. ① Take out a tenser unit from an empty pirn, ② take out the empty pirn, ③ mount a full-loaded pirn and 4 attach a tenser unit to the full-loaded pirn. 1 to ④ are concerned with the change of empty and full-loaded pirns. Then, ⑤ a full-loaded bobbin (hereinafter, a package at the winding side of a double twister is referred to as a bobbin) and an empty bobbin are replaced with each other.

The above changing operations ① to ⑤ inevitably involve the conveyance of empty pirn, full-loaded pirn, empty bobbin and full-loaded bobbin. The conveyance system practically used in the double twister for spun yarn may be effective for automating such changing operations ① to ⑤ and conveyance. According to the said conveyance system, a conveyor for the supply of full-loaded pirns and for the recovery of empty pirns and a conveyor for the discharge of full-loaded bobbins are used in cooperation with a doffing device capable of traveling around a machine frame to perform the changing operations ① to ⑤.

However, since the doffing cycle in the double twister for filament is as long as 3 to 20 days, it is necessary to provide a conveyor for each machine frame, and the provision of a doffing device causes an increase of instrumental waste. In the double twister for filament, moreover, spindles are arranged in two vertical stages in many cases, so the use of a dolling device or the like results in the machine height become too large.

SUMMARY OF THE INVENTION

The present invention has been accomplished in view of the above-mentioned problems of the prior art and it is the object of the invention to provide a package changing system which does not require the provision of a conveyor for each machine frame and which has introduced a certain function of a dofflag device therein.

A package changing system according to the present invention for achieving the above-mentioned object includes a first rail provided vertically movably in parallel with the arranged direction of a large number of spindles arranged in rows and for which empty packages and full-loaded packages are to be replaced with each other; a second rail to be connected to the first rail in a raised position of the first rail; and a conveyance unit provided along the second rail so that it can travel, the conveyance unit having chuck means necessary for the change of package and being capable of entering and leaving the first rail.

When the change of package is needed, the conveyance unit having chuck means necessary for the change of package is carried from the second rail into the first rail located in its raised position, then the first rail moves down to chuck, for example, empty packages simultaneously with respect to the many spindles and returns to its raised position, then the conveyance unit chucking the empty packages is carried out from the first rail to the second rail. Likewise, the conveyance unit now chucking full-loaded packages is carried into the first rail from the second rail, which in turn moves down to supply the full-loaded packages simultaneously to the many spindles. Thus, with such vertical movements of the first rail which holds the conveyance unit, the chucks of the conveyance unit permit the package changing work for all of the spindles simultaneously, thus serving for both conveying and changing operations.

For achieving the foregoing object, there also may be adopted a construction including a rail having a portion parallel to the arranged direction of a large number of spindles arranged in rows and for which empty packages and full-loaded packages are to be replaced with each other; and a conveyance unit held by the rail so that it can travel, the conveyance unit having chuck means necessary for the change of packages, the said rail having a plurality of branch rails for holding plural such conveyance units for different articles separately so that the conveyance units can enter and leave the branch rails.

In the change of packages, since one packages are empty ones and the other are full-loaded ones, if a conveyance unit for the former and a conveyance unit for the latter are held separately by branch rails so that they can enter and leave the rails, it is made possible to perform a continuous changing operation involving carrying out of empty packages using the empty package conveying unit and subsequent carrying in of full-loaded packages using the full-loaded package conveying unit.

For permitting the change of packages over two or more vertical stages, this package changing system includes a rail provided vertically movably in parallel with the arranged direction of spindles arranged in rows and in two or more vertical stages and for which empty packages and full-loaded packages are to be replaced with each other; and a conveyance unit having chuck means necessary for the change of packages and capable of entering and leaving the rail, the said rail being vertically movable selectively for each of the vertical stages.

When the change of packages is needed in a lower stage, the rail is moved vertically with respect to the lower stage and the change of packages at the lower stage is performed using the chucks of the conveyance unit held by the rail, while when it is necessary to effect the change of packages at an upper stage, the rail is moved vertically for the upper stage and the change of packages at that stage is conducted using the chucks of the conveyance unit held by the rail. By switching the degree of vertical movement selectively it is made possible to effect the change of packages at any of upper and lower stages.

BRIEF DESCRIPTION OF THE DRAWINGS

FIGS. 8*a* and 8*b* are views showing another embodiment of the present invention, in which FIG. 8*a* is a front view of a double twister and FIG. 8*b* is a front view of a pirn winder;

FIGS. 9*a* and 9*b* are side views of FIG. 8, in which FIG. 9*a* is a side view of the double twister and FIG. 9*b* is a side view of the pirn winder;

DETAILED DESCRIPTION OF PREFERRED EMBODIMENTS

Figure 1:
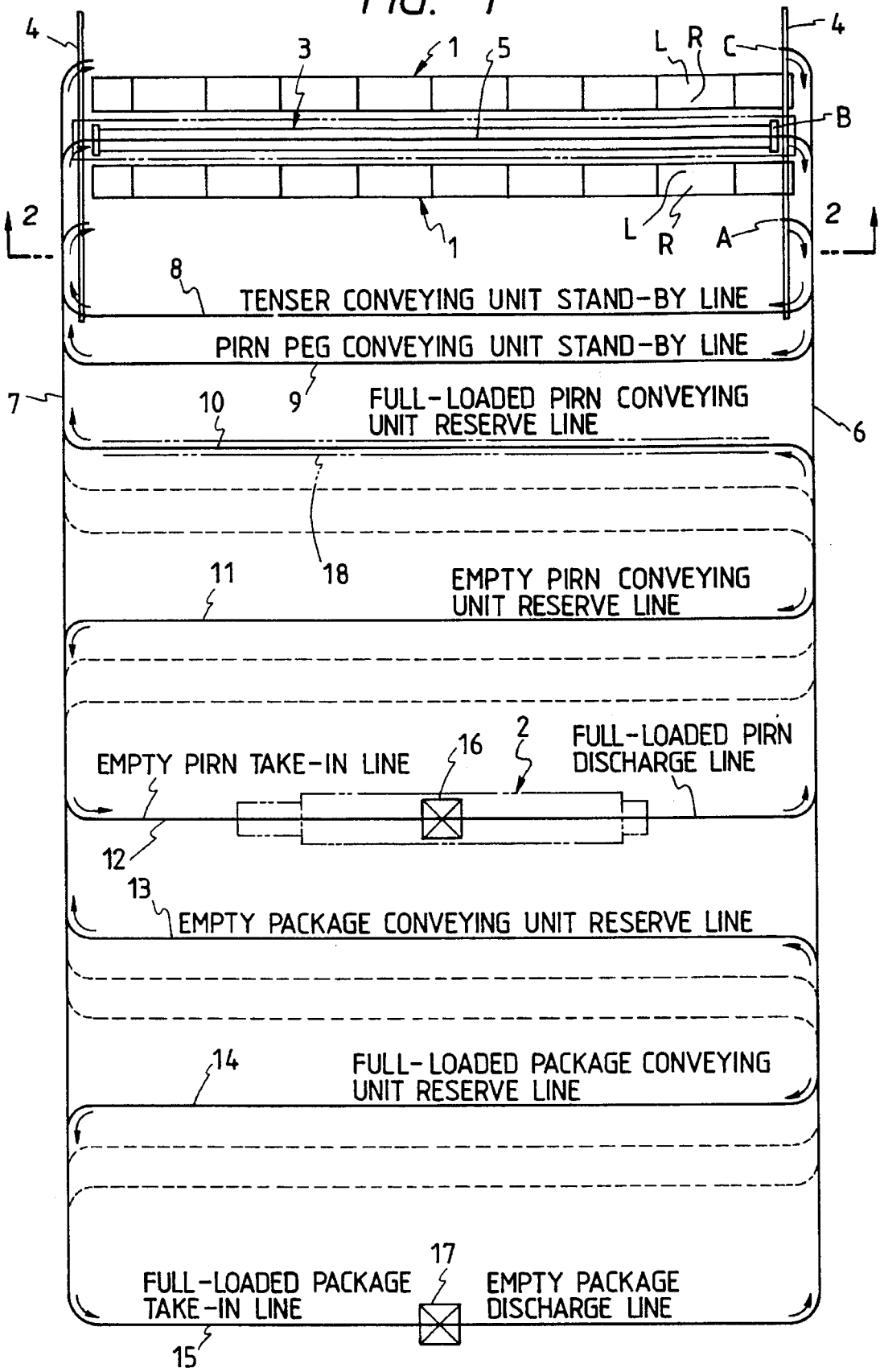
FIG. 1 is a layout diagram of rails in a conveyance system embodying the present invention.
Figure 3:
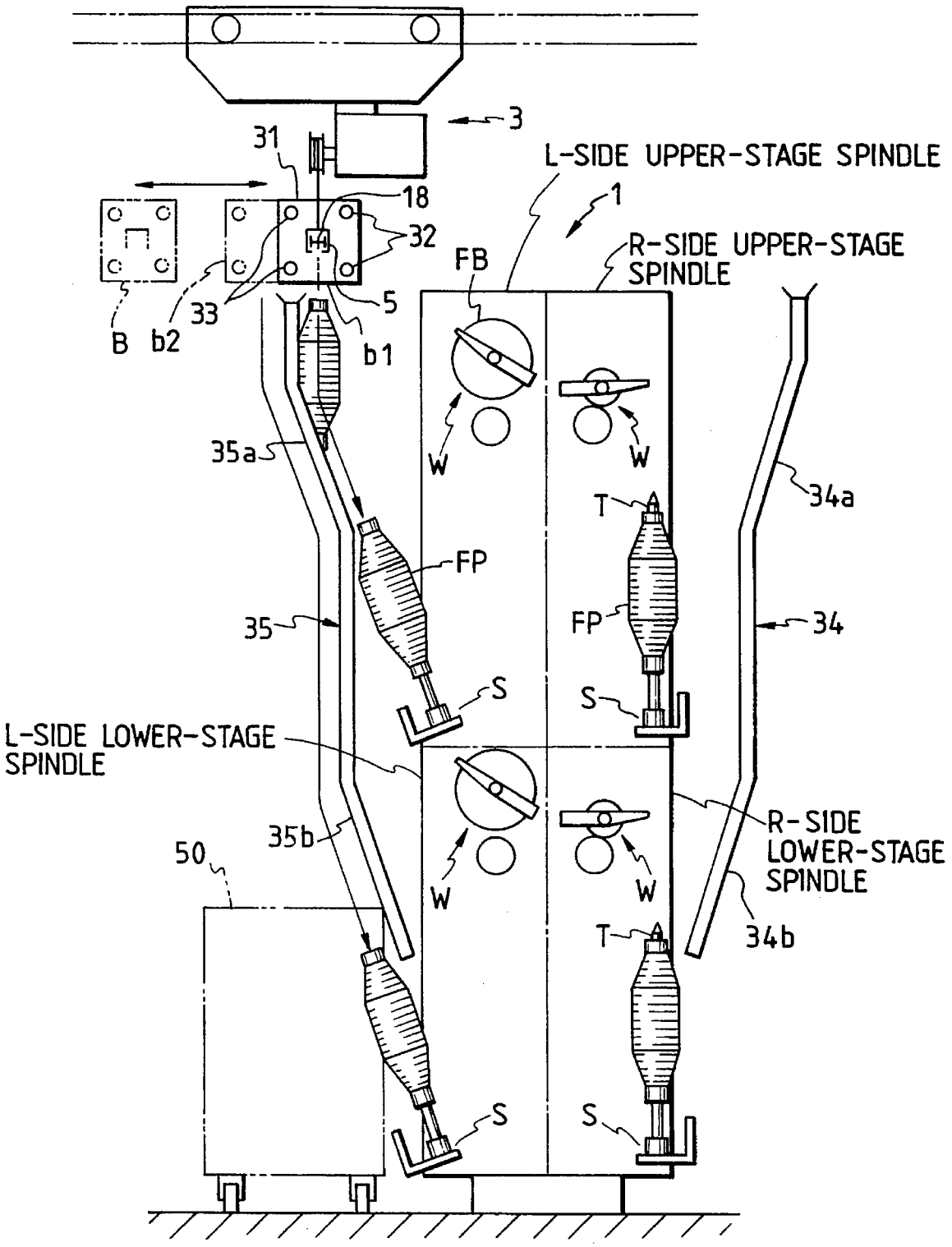
FIG. 3 is a view as seen in the direction of arrow Y—Y in FIG. 2.
Figure 4:
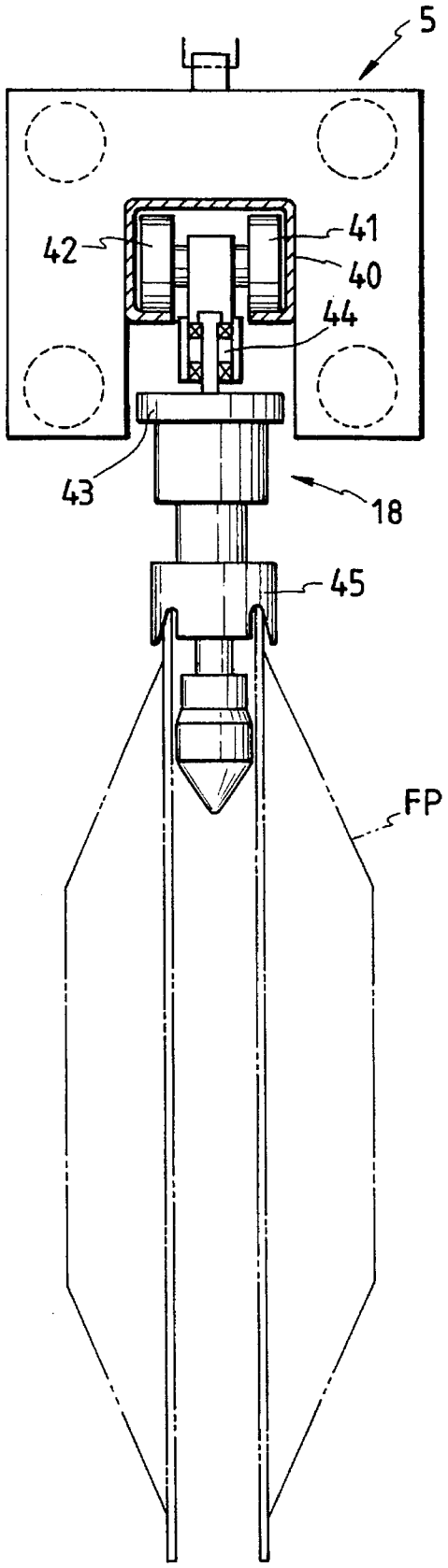
FIG. 4 is a sectional view taken on line Z—Z in FIG. 2.

An embodiments of the present invention will be described hereinunder with reference to the drawings. FIG. 1 is a layout diagram of rails used in a conveyance system embodying the invention, FIG. 2 is a view as seen in the direction of arrow X—X in FIG. 1, FIG. 3 is a view as seen in the direction of arrow Y—Y in FIG. 2, and FIG. 4 is a sectional view taken on line Z—Z in FIG. 2.

In FIG. 1, the numeral 1 denotes a double twister (machine frame) for filament; numeral 2 denotes a pirn winder; numeral 3 denotes an overhead traveling crane; numeral 4 denotes a traveling track of the crane 3; numeral 5 denotes a vertically movable rail (first rail) suspended from the overhead traveling crane 3; numerals 6 and 7 denote connecting rails (second rails) laid along the ceiling; numeral 8 to 15 denote branch rails (second rails) laid along the ceiling; and numeral 16 denotes an empty pirn/full-loaded pirn changing station; and numeral 17 denotes an unloading station. Through these rails 5 to 15 a bendable conveyance unit 18, etc. are allowed to travel by external drive means (not shown) and can enter a desired line provided in the branch rails 8 to 15.

Figure 2:
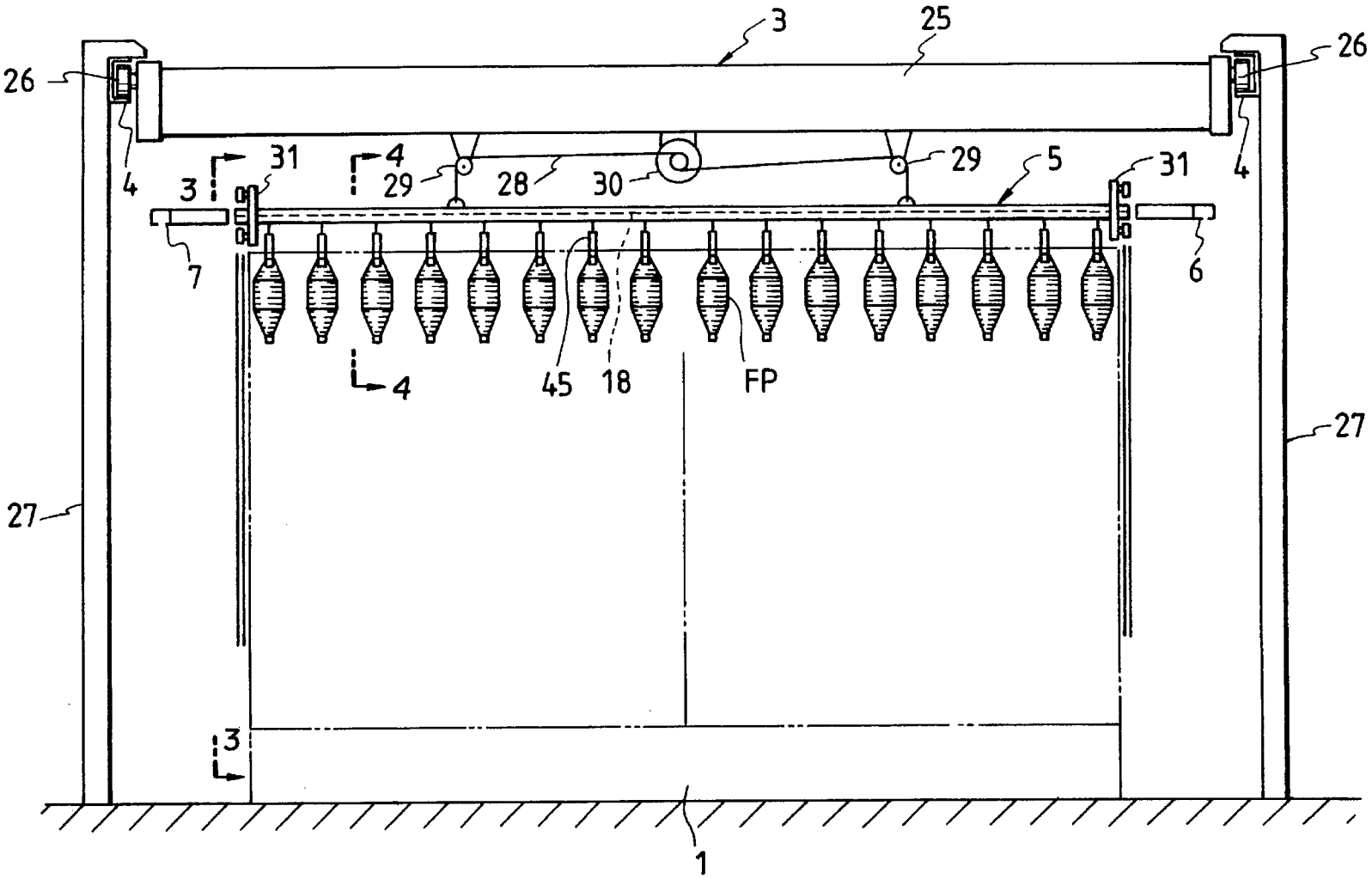
FIG. 2 is a view as seen in the direction of arrow X—X in FIG. 1.

As shown in FIG. 2, the overhead traveling crane 3 has wheels 26 supported laterally through shafts at both ends of a beam 25 which is disposed to cross the machine frame 1 formed in rows. The wheels 26 are each located within the traveling track 4 laid on a pillar 27, and the overhead traveling crane 3 can travel in the direction of the tracks 4. The machine frame 1 has many spindles. In the same figure there is shown a single span type wherein two 8-spindle units are arranged. But usually there is adopted a longer arrangement in the transverse direction, like 16 spindles ×8 spans.

The vertically movable rail 5 is suspended from the overhead traveling crane 3 through a rope 28. The rope 28 is connected through guides 29 to a hoist 30. By means of the hoist 30, the rail 5 can be moved from its raised position illustrated in the figure down to a desired position and then again up to the original raised position. The conveyance unit 18 can enter or leave the rail 5, and chucks 45 projecting downwards from the conveyance unit 18 hold fully-loaded pirns FP by a number corresponding to all the spindles (e.g. 16×8 spindles in the case of 16 spindles×8 spans) in the machine frame. Projecting downwards from the conveyance unit 18 are chucks or hangers according to the kind of article to be conveyed.

Flanges 31 are mounted to both inlet and output of the vertically movable rail 5, and first guide rollers 32 and second guide rollers 33 are journaled in the flanges 31, as shown in FIG. 3. In the machine frame 1, upper- and lower-stage spindles on R side and upper and lower-stage spindles on L side are arranged back to back, each spindle having a swingable spindle S and a winder W, with a tenser T being attached to the spindle S. The yarn unwound from each full-loaded pirn FP is twisted twice at the spindle S and then wound into a fully-loaded bobbin FB by means of the winder W. On both sides of the machine frame 1 there are mounted an R-side guide 34 and an L-side guide 35 symmetrically right and left. The guides 34 and 35 have upper slants 34*a*, 35*a* and lower slants 34*b*, 35*b*. When the second guide rollers 33 are selected and the full-loaded pirn FP enters the guide 35 and arrives at the upper slant 35*a*, for example as illustrated in the figure, the full-loaded pirn FP is loaded onto the spindle S of the upper-stage spindle on L side. When the first guide rollers 32 are selected and the full-loaded pirn FP enters the guide 35 and arrives at the lower slant 35*b*, for example as illustrated in the figure, the pirn FP is loaded onto the spindle S of the lower-stage spindle on L side. By operations reverse to the above, the tenser T and empty pirn can be pulled out from the spindle S.

Intermediate between the machine frames 1 there is provided a raised connecting position B for the vertically movable rail 5. The connecting rails 6, 7 and the vertically movable rail 5 shown in FIG. 1 are connected together in the raised connecting position B, thereby permitting a desired conveyance unit 18 such as that shown in any of FIGS. 5*b*, 6*b* and 7*b* to be carried in or out.

As shown in FIG. 4, the vertically movable rail 5 is an elongated hollow, square member 40 having a slit bottom, and rollers 41 and 42 of the conveyance unit 18 travel within the square member 40. In the conveyance unit 18, the rollers 41 and 42 are provided rotatably through bearings 44 on the upper side of a base plate 43, while on the lower side of the base plate 43 there are provided chucks 45 projectingly.

Figure 5A:
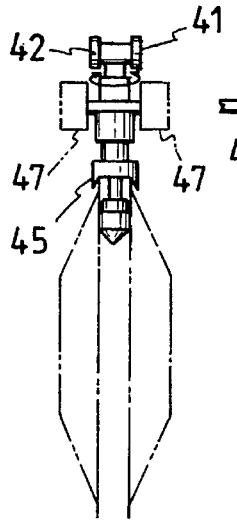
FIGS. 5*a* and 5*b* are views showing a conveyance unit, inside and front views, respectively, with chucks for full-loaded pirn suspended therefrom.
Figure 5B:
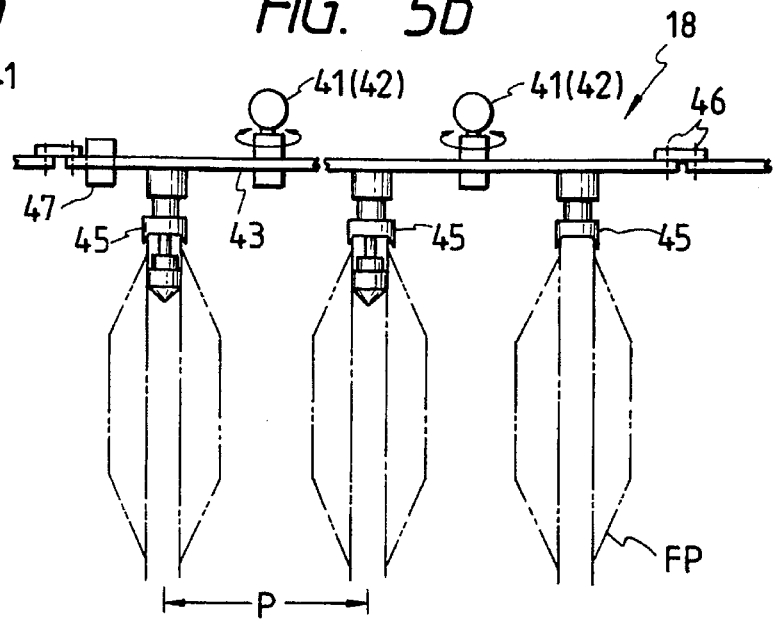

Various conveyance units will now be described with reference to FIGS. 5*a*, 5*b*, 6*a*, 6*b* and 7*a*, 7*b*. The conveyance unit 18 shown in FIG. 5*a*, 5*b* is for the conveyance of full-loaded pirns and empty pirns. When holding full-loaded pirns as shown in the same figure, the conveyance unit 18 is a full-loaded pirn conveyance unit, while when holding empty pirns, it is an empty pirn conveyance unit, and when holding nothing, it is a chuck conveyance unit. Since two sets of rollers 41, 42 are disposed rotatably on the upper side of the base plate 43, these rollers rotate as indicated by arrows even at curved rail portions (not shown) to permit traveling of the conveyance unit. On the other hand, usually four chucks 45 which can open and close are provided projectingly on the lower side of the base plate 43. When each chuck 45 opens within the take-up tube of the associated full-loaded or empty pirn, the pirn can be held, while upon closing of the chuck, the pirn is released. A large number of base plates 43 are connected together using pins 46, and there are conveyed chucks 45 by a number corresponding to the number of spindles arranged in the longitudinal direction of the machine frame. Therefore, the pitch P between adjacent chucks 45 is made coincident with the spacing between adjacent spindles in the longitudinal direction. For causing this conveyance unit to travel, driving rollers 47 are mounted on a rail (not shown) at predetermined certain intervals within the overall length of the coupled body, and the base plates 43 travel in a sandwiched fashion between the driving rollers 47.

Figure 6A:
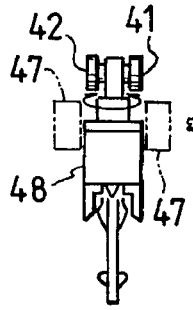
FIGS. 6*a* and 6*b* are views showing a conveyance unit, inside and front views, respectively, with chucks for tenser suspended therefrom.
Figure 6B:
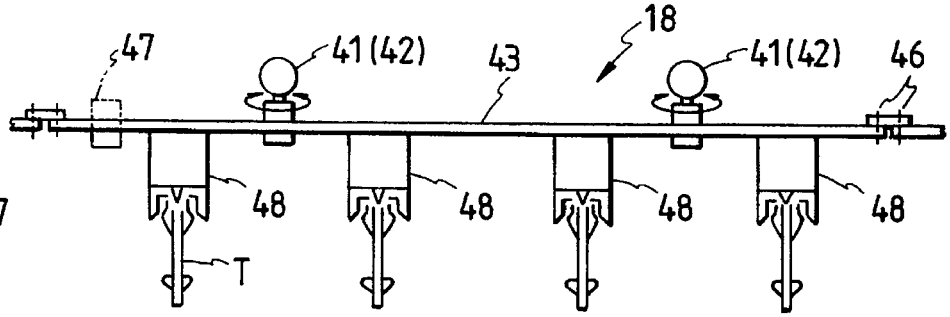

FIGS. 6*a*, 6*b* illustrates a tenser conveying unit 18. It is tenser chucks 48 that are provided projectingly on the lower side of each base plate 43, and in this point the conveyance unit shown in FIG. 6*a*, 6*b* is different from that shown in FIG. 5*a*, 5*b*. The tenser chucks 48 can open and close to hold and release tensers T.

Figure 7A:
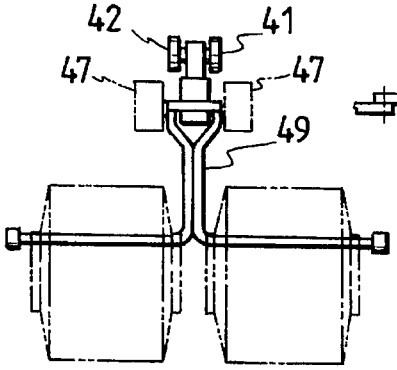
FIGS. 7*a* and 7*b* are views showing a conveyance unit, inside and front views, respectively, with hangers for full-loaded bobbin suspended therefrom.
Figure 7B:
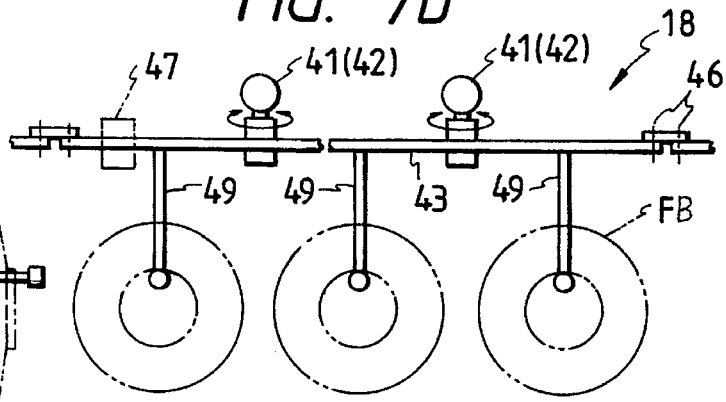

FIGS. 7*a*, 7*b* illustrates a conveyance unit 18 for full-loaded bobbins and empty bobbins. This conveyance unit is different from that shown in FIGS. 5*a*, 5*b* in that T-shaped hangers 49 are provided projectingly on the lower side of each base plate 43. As shown in the same figure, when full-loaded bobbins are inserted, the conveyance unit is a full-loaded bobbin conveying unit, while when empty bobbins are inserted, the conveyance unit is an empty bobbin conveying unit. The loading of full-loaded bobbins FB to the hangers 49 is performed by an operator. The empty bobbins loaded on the hangers 49 are pulled out and instead the full-loaded bobbins FB are loaded thereon by the operator. Since the operator's work for the upper-stage spindles in FIG. 3 is performed in a high position, there is used a workbench 50. When the operator is to work for the lower stage spindles, the whole of the vertically movable rail 5 moves down to a height easy for the operator to work.

Referring back to FIG. 1, a traveling route of each of the conveyance units 18 shown in FIGS. 5*a*, 5*b*, 6*a*, 6*b* and 7*a*, 7*b* will now be described. The vertically movable rail 5 suspended from the overhead traveling crane 3 has raised connecting positions A, B, C, . . . . The connecting position A is for R side of the lower machine frame 1, while the raised connecting position B is for both L side of the lower machine frame 1 and R side of the upper machine frame 1. The branch rail 8 is for entering of the tenser conveying unit shown in FIG. 6*a*, 6*b*. The tenser conveying unit in a state not holding the tensers enters the vertically movable rail 5 located in a predetermined connecting position, then the rail 5 moves down selectively to the upper or lower stage, then after removal of the tensers T from empty pirns, the conveyance unit returns to the branch rail 8 and stands by.

In the branch rail 9 there stands by the chuck conveying unit in an unloaded state of the chucks 45 shown in FIG. 5*a*, 5*b*. The chuck conveying unit enters the vertically movable rail 5 located in a predetermined raised connecting position, then the rail 5 moves down for empty pirns after removal of the tensers T shown in FIG. 3 and holds the empty pirns, and the empty pirn conveying unit is reserved in the branch rail 11. The dotted line indicates a spare reserve line. The empty pirn conveying unit in the branch rail 11 enters an empty pirn take-in line of the branch rail 12, then after replacement of empty pirns and full-loaded pirns with each other successively in the empty pirn/full-loaded pirn changing station 16, the conveyance unit passes through a full-loaded pirn discharge line, enters the connecting rail 6 and is reserved at the reserve line as a full-loaded pirn conveying unit at the branch rail 10.

The full-loaded pirn conveying unit at the branch rail 10 passes through the connecting rail 7 and enters the vertically movable rail 5 located in a predetermined raised connecting position, loads the full-loaded pirns onto the empty pirn-removed spindles in FIG. 3, then as an empty chuck conveying unit, it enters a stand-by line of the branch line 9 and stands by.

The empty bobbin conveying unit at the branch rail 13 is reserved in a loaded state of empty bobbins onto hangers shown in FIG. 7*a*, 7*b*. It enters the vertically movable rail 5 located in a predetermined raised connecting position, and after replacement of empty bobbins and full-loaded bobbins with each other successively by the operator, it becomes a full-loaded bobbin conveying unit, which is reserved in the reserve line of the branch rail 14. The full-loaded bobbin conveying unit at the branch rail 14 passes through the connecting rail 7 and enters a full-loaded bobbin take-in line of the branch rail 15, then after exchange of full-loaded bobbins and empty bobbins with each other at the unloading station 17, the conveyance unit enters the reserve line of the branch rail 13 through an empty bobbin discharge line and the connecting rail 6 and is reserved therein.

Now, with reference to FIG. 1, the following description is provided about a doffing procedure, (1)–(29), in the double twister for filament, using the conveyance system described above.

(1) It is here assumed that the machine frame (e.g. L side of the lower machine frame 1) in FIG. 1 has stopped.

(2) The overhead traveling rail 3 which has hoisted the vertically movable rail 5 in an unloaded state up to the upper-limit position travels to the raised connecting portion B.

(3) The tenser conveying unit (in an unloaded state in FIGS. 6*a*, 6*b* at the branch rail 8 passes through the connecting rail 7 and travels into the vertically movable rail 5.

(4) The overhead traveling crane 3 travels to position b1 as in FIG. 3.

(5) The vertically movable rail 5 moves down and the tenser conveying unit holds the tensers T of the upper-stage spindles on L side simultaneously. Then, the rail 5 is moved up and the overhead traveling crane 3 travels up to the raised connecting position B and stops.

(6) The tenser conveying unit (in the state shown in FIG. 6) which holds the tensers travels up to a stand-by line of the branch rail 8 in FIG. 1.

(7) The chuck conveying unit (in an unloaded state in FIGS. 5*a*, 5*b* at the branch rail 9 travels into the vertically movable rail 5.

(8) The overhead traveling crane 3 in FIG. 3 travels to position b1.

(9) The rail 5 is moved down and the empty pirns on the L-side upper-stage spindles are taken out simultaneously by the chucks of the chuck conveying unit. The rail 5 is then moved up and the overhead traveling crane 3 travels up to the raised connecting position B and stops.

(10) The conveyance unit which holds empty pirns (in place of the full-loaded pirns FP in FIGS. 5*a*, 5*b* travels up to the reserve line of the branch rail 11.

(11) The full-loaded pirn conveying unit (in the state shown in FIG. 5) reserved in the branch rail 18 travels into the vertically movable rail 5.

(12) The overhead traveling crane 3 in FIG. 3 travels to position b1.

(13) The rail 5 is moved down and the chucks of the full-loaded pirn conveying unit are opened to load the full-loaded pirns simultaneously onto the L-side upper-stage spindles. The rail 5 is then moved up and the overhead traveling crane 3 travels up to the raised connecting position B and stops.

(14) The conveyance unit (in an unloaded state in FIG. 5) travels to the chuck conveying unit stand-by line of the branch rail 9 in FIG. 1.

(15) The tenser conveying unit (in the state of FIGS. 6*a*, 6*b* which holds the tensers passes through the connecting rail 7 and enters the vertically movable rail 5.

(16) The overhead traveling crane 3 in FIG. 3 travels to position b1.

(17) The vertically movable rail 5 is moved down and the chucks of the tenser conveying unit are opened to attache the tensers simultaneously to the full-loaded pirns on the L-side upper-stage spindles. The rail 5 is then moved up and the overhead traveling crane 3 travels up to the raised connecting portion B and stops.

(18) The tenser conveying unit now in an unloaded state travels to position b2.

(19) Also for the lower-stage spindles, the above operations (5) to (17) are repeated to complete the change of pirns.

(20) The tenser conveying unit in an unloaded state travels to the stand-by line of the branch rail in FIG. 1.

(21) The empty bobbin conveying unit in the branch rail 13 passes through the connecting rail 7 and enters the vertically movable rail 5.

(22) For the upper-stage spindles, empty bobbins and full loaded bobbins are replaced with each other simultaneously with threading by the operator. The conveyance unit now assumes the state shown in FIG. 7. In this bobbin changing operation for the upper-stage spindles, the workbench 50 shown in FIG. 3 is used, and the vertically movable rail 5 is in its upper-limit position (position B).

(23) The full-loaded bobbin conveying unit travels up to the full-loaded bobbin conveying unit reserve line of the branch rail 14 in FIG. 1.

(24) The empty bobbin conveying unit in the branch rail 13 passes through the connecting rail 7 and enters the vertically movable rail 5.

(25) For the lower-stage spindles, empty bobbins and full-loaded bobbins are exchanged simultaneously with threading by the operator. Now there appears the state of FIGS. 7*a*, 7*b*. At this time, the vertically movable rail 5 is brought down to a height easy for work from the raised position (position B).

(26) The full-loaded bobbin conveying unit travels up to the full-loaded bobbin conveying unit reserve line of the branch rail 1, in FIG. 1.

(27) Also as to R side, there are performed pirn changing, threading and exchange of full-loaded and empty bobbins by repeating the same operations as the above (1) to (26).

(28) The overhead traveling crane returns to its home position (not shown) and the operation of the machine frame starts.

(29) The fully-loaded bobbin conveying unit reserved in the branch rail 14 passes through the connecting rail 7 and enters the full-loaded bobbin take-in line of the branch rail 15, then after exchange of full-loaded and empty bobbins at the unloading station 17, the conveyance unit becomes an empty bobbin conveying unit, arrives at the empty bobbin conveying line, passes through the connecting rail 6 and is reserved in the empty bobbin conveying unit reserve line of the branch rail 13.

Through the above operations there is performed the change of pirns automatically using a minimum required number of components in each machine frame. Although threading and the exchange of full-loaded and empty bobbins require the operator's hand, the conveyance of bobbins to the operator's working place is performed automatically. This package conveying system is applicable not only to the double twister for filament but also to any other textile machine having a large number of spindles for the exchange of packages. In this case, as chucks or hangers suspended from the conveyance unit, there are used those suitable for the machine to which the package conveying system is applied.

In the above embodiment, the vertically movable rail can travel in the direction of crossing the machine frames by means of the overhead traveling crane in order to use the sole vertically movable rail in common to plural machine frames. However, in the case where the number of machine tools is small, vertically movable rails may be fixedly suspended along the side faces of the machine frames vertically movable. If a switching means is provided at the inlet of the upper slant 35*a* of the guide 35 in FIG. 3 and there is formed a bypass extending from the said switching means to the lower slant 35*b*, there is no need of movement between the positions b1 and b2 in FIG. 3, the vertically movable rail is brought down in either position, and the upper or lower-stage spindles can be selected by the switching means. Instead of using the vertically movable rail, the conveyance unit may be provided with chucks capable of vertically moving simultaneously.

According to the package changing system of the present invention, when the change of package is needed, the conveyance unit having chuck means necessary for the change of package is carried from the second rail into the first rail located in its raised position, then the first rail moves down to chuck, for example, empty packages simultaneously with respect to many spindles and returns to its raised position, then the conveyance unit chucking the empty packages is carried out from the first rail to the second rail. Thus, the conveyance unit is used for both conveyance and changing work and an automatic exchange of packages can be attained by a simple machine construction.

According to the package conveying system of the present invention, moreover, since one packages are empty ones and the other are full-loaded ones, by holding a conveyance unit for the former and a conveyance unit for the latter separately using branch rails so that they can enter and leave the rails, it is made possible to perform a continuous exchanging operation involving carrying out of empty packages using the empty package conveying unit and subsequent carrying in of full-loaded packages using the full-loaded package conveying unit. Thus, by a simple machine construction of merely using plural conveyance units and branch rails, it is made possible to attain a quick exchange of packages.

According to the package changing system of the present invention, when the change of packages is needed in a lower stage, the vertically movable rail is moved vertically with respect to the lower stage and the change of packages at the lower stage is performed using the moved vertically with respect to the lower stage and the change of packages at the lower stage is performed using the chucks of the conveyance unit held by the rail, while when it is necessary to effect the change of packages at an upper stage, the rail is moved vertically for the upper stage and the change of packages at that stage is conducted using the chucks of the conveyance unit held by the rail. By switching the degree of vertical movement selectively it is made possible to effect the change of packages at any of upper and lower stages. Thus, packages of two or more vertical stages can be exchanged by a simple construction of making a rail vertically movable selectively.

Another embodiment of the present invention will be described below. A package changing system according to this embodiment can exchange packages simultaneously between machine frames of different spans.

The package changing system has a conveyance unit adapted to travel between machine frames of different spans and move vertically to exchange plural packages simultaneously. The conveyance unit is formed in conformity with the longest span and is divided at least in the unit of the shortest span and a coupling means for engagement and disengagement is disposed at divided end portions.

In the above construction, the conveyance unit receives packages through vertical movement with respect to the machine frames on the package producing side and supplies the packages through vertical movement with respect to the machine frames on the consuming side. When the conveyance unit moves vertically with respect to a machine frame of a short span, the coupling means divides the conveyance unit in the position corresponding to that span.

This embodiment will be described below with reference to the accompanying drawings.

Figure 12:
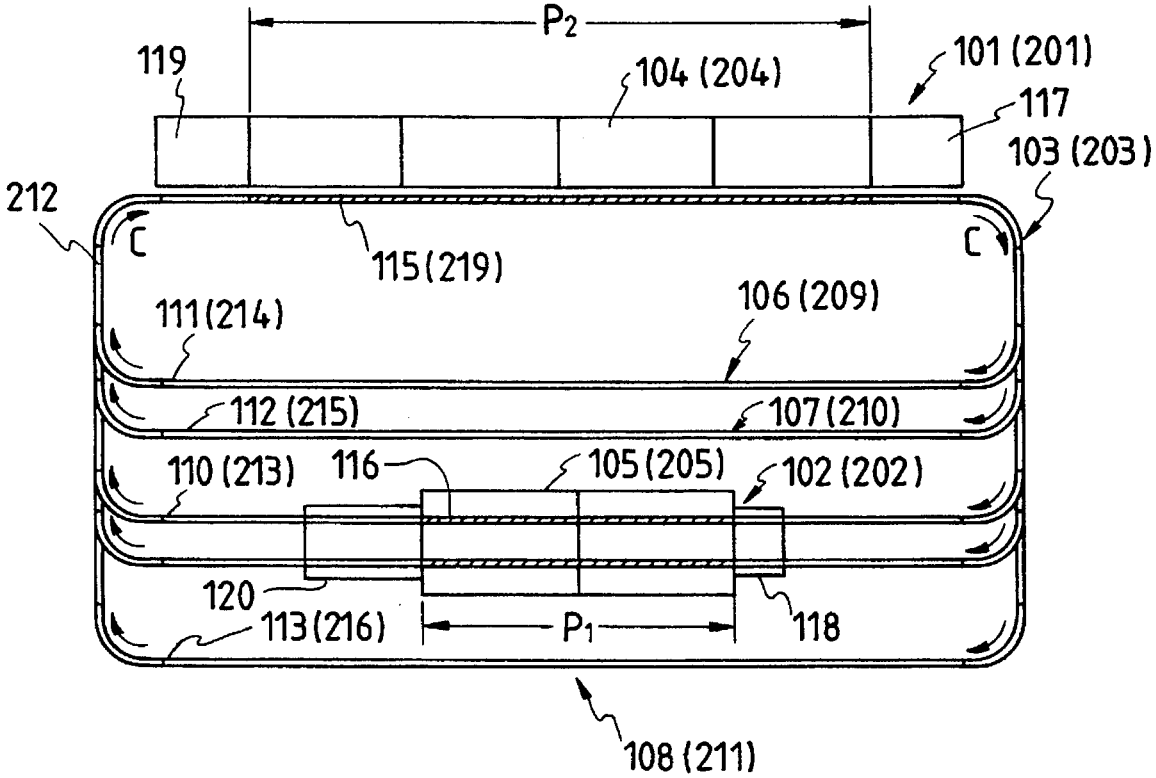
FIG. 12 is a plan view showing the whole of FIG. 8.

First, the entire construction will be described with reference to FIG. 12. According to the package changing system of this embodiment, a conveyance path 103 which connects a double twister 101 for filament and a pirn winder 102 directly with each other is formed in a loop shape along machine frames 104 and 105, and conveyance units travel along the conveyance path 103. As the conveyance units there are used a tenser carriage for attachment thereto and detachment therefrom of tensers and for conveyance thereof and a package carriage for the conveyance of packages produced by the double twister 101, in addition to a pirn carriage for the conveyance of empty pirns and full-loaded pirns. Disposed in parallel with the machine frames 104 and 105 are a stand-by station 106 for the tenser carriage, a stand-by station 107 for the empty pirn carriage and a station 108 for the exchange of package take-up tubes, and there are formed branch conveyance path, 110, 111, 112 and 113 which connect the double twister 101 with the pirn winder and the stations 106, 107, 108. Since the pirn producing speed of the pirn winder 102 is much higher than the pirn consuming speed of the double twister, the number of spindles $n_1$ and span $p_1$ are set half of the number of spindles $n_2$ and span $p_2$ in the double twister ($n_1=½\ n_2$, $p_1=½\ p_2$). The spans $p_1$ and $p_2$ are substantial machine frame lengths exclusive of motor boxes 117, 118 and gear boxes 119, 120 of the machine frame 104 and 105.

Figure 8A:
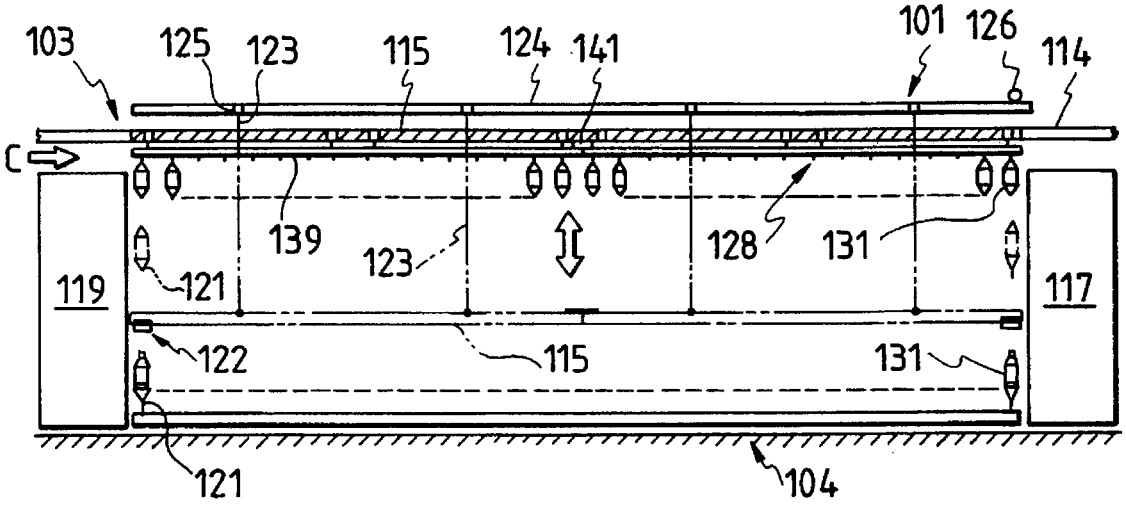
Figure 8B:
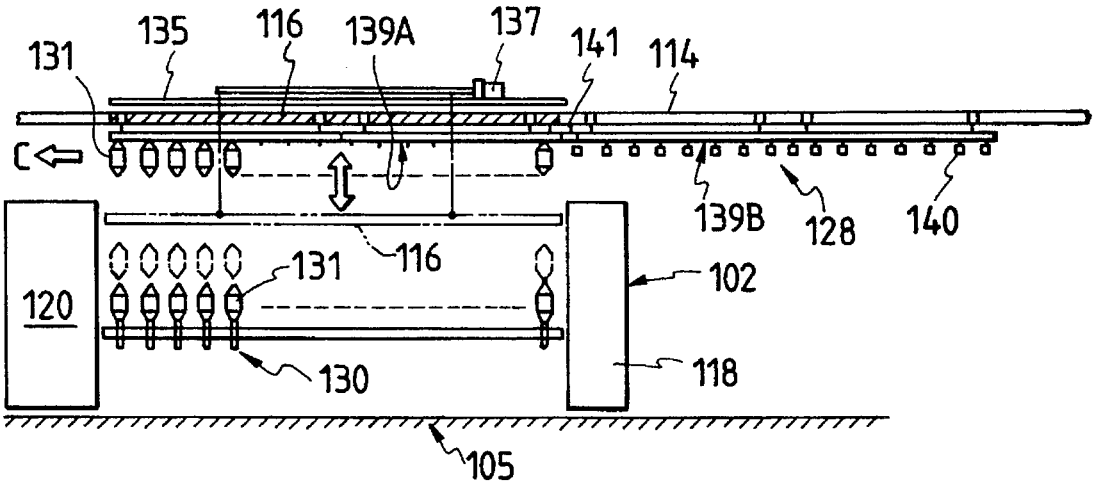
Figure 9A:
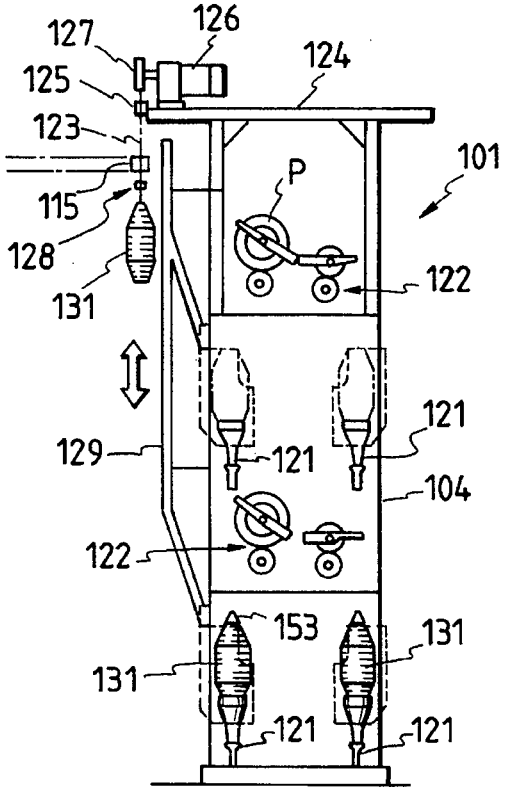
Figure 9B:
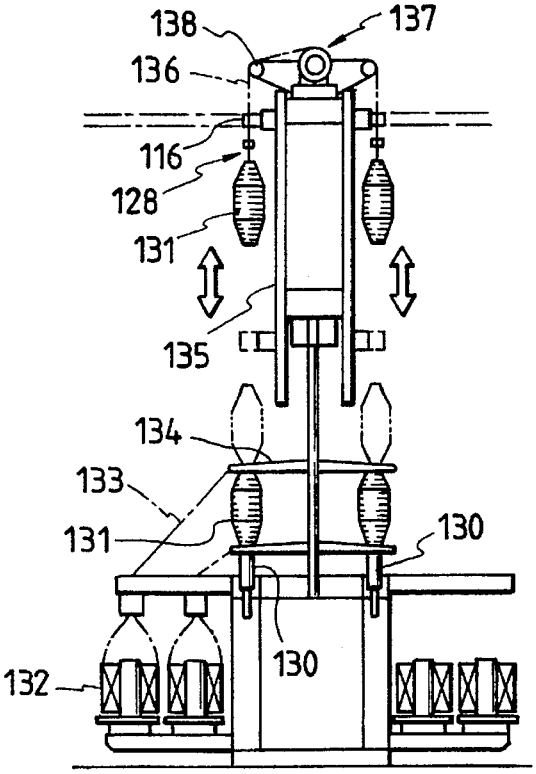

As shown in FIGS. 8 and 9, the conveyance path 103 of the portion extending along the machine frames 104 and 105 is composed of fixed rails 114 extending outwards from both ends of the machine frames 104, 105 and rails 115 and 116 which are movable vertically between the fixed rails 114. The vertically movable rails 115 and 116 are formed to have lengths equal to the spans $p_2$ and $p_1$. In the double twister 101, a large number of spindles are arranged in two stages and in parallel. Each spindle comprises a spindle 121 and a winder 122 for taking up yarn (filament) which has been twisted by the spindle 121. Wires (steel belts) 123 are attached to the vertically movable rail 115 at suitable intervals. An upper frame 124 of the machine frame 104 is provided with a roller 125 and a motor 126. The wires 123 are wound or unwound by means of a pulley 127 of the motor 126 through the roller 125, whereby the vertically movable rail 115 is moved up and down in a predetermined range. An upper end position of the vertical movement is the same level as the fixed rails 114, while a lower end position thereof is the level at which a pirn carriage performs the change of pirns. The machine frame 104 is provided with a guide 129 for guiding the vertical movement of the vertically movable rail 115. The guide 129 extends vertically on the front side of the double twister 101 and branches in intermediate positions toward upper and lower spindles 121. In the pirn winder 102, core tubes of pirns 131 are fitted in a two-stage overlap form on each of spindles 130 disposed at the same intervals as that of the spindles of the double twister 101, to take up filament 133 from a feed yarn package 132 through a traverse motion 134. For removing the pirns 131 from the spindles 130, first the upper pirn 131 is pulled out and then the lower pirn 131 is lifted by means of a cylinder (not shown) or the like. The vertically movable rail 116 is positioned on the axes of the spindles 130, and on a machine frame portion 135 there are mounted a motor 137 and a roller 138 for driving the rail 116 vertically through the wires 136.

The pirn carriage 128 comprises a carriage bar 139 having an overall length equal to that of the vertically movable rail 115 of the double twister 101 and chucks 140 attached to the carriage bar 139 at intervals equal to that of the spindles. The carriage bar 139 is divided in the longitudinal direction so that it can curve at curved sections of the conveyance path 103. In this embodiment, the carriage bar 139 is divided into eight portions with the length including four spindles (chucks 140) as one unit. In the central divided position, namely the position corresponding to the span $p_1$ of the pirn winder 102, there is provided a coupling means 141 as a characteristic feature of the present invention.

Figure 10:
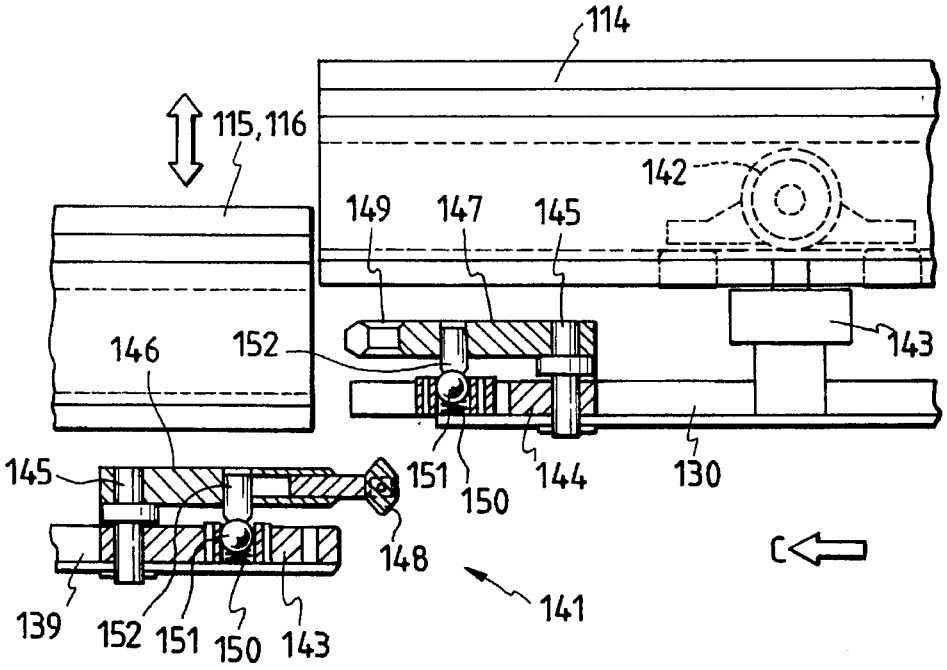
FIG. 10 is a front view of a coupling means shown in FIG. 8.
Figure 11:
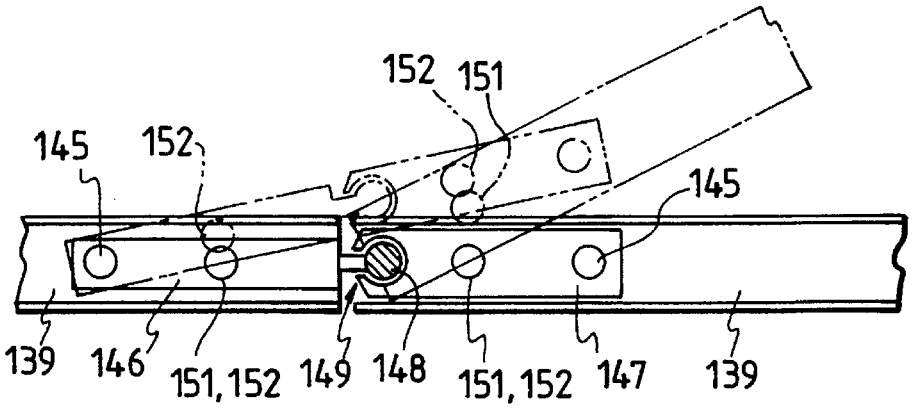
FIG. 11 is a plan view showing a principal portion of FIG. 10.

As shown in FIGS. 10 and 11, the carraige bar 139 is constituted by a plate which is bent upwards on both sides in its width direction, above which are disposed traveling rollers 142 at suitable intervals through a mounting member 143. The traveling rollers 142 are adapted to roll on the inner rail surfaces of the lower ends of the rails 114, 115 and 116 which are formed as hollow rails having a rectangular section. The coupling means 141 comprises bases 143 and 144 which are mounted to divided end portions and connecting rods 146 and 147 which are disposed above and in parallel with the bases 143, 144. Base ends of the connecting rods 146 and 147 are pivotally supported by vertical pins 145 implanted in the bases 143 and 144. Both connecting rods are positioned in such a manner that the respective distal ends are opposed to each other. To the distal end of one connecting rod 146 is attached an elliptic ball-like joint member 148, while in the distal end of the other connecting rod 147 is formed a joint hole 149 for enclosing and grasping the joint member 148 in the horizontal direction. That is, while a relative movement in the vertical direction is allowed, there is made restraint in the traveling direction C in the jointed state. The bases 143 and 144 are each provided with a ball 151 which is urged upward by means of a spring 150, while downwardly projecting from each of the connecting rods 146 and 147 is a short rod 152 having a lower end face which is recessed in a shape conforming to the spherical surface of the ball 151. More specifically, as indicated by a dash-double dot line in FIG. 11, in a curved section of the conveyance path 103, the connecting rods 146 and 147 turn around the vertical pins 145 while they are in a linearly jointed state, in conformity with bending of the traveling carriage bar 139. When the carriage bar 139 returns to a linear section, the ball 151 and the short rod 152 which have been displaced from each other are fitted together by the biasing force of the spring 150, thus causing the connecting rods to each turn in the opposite direction and revert to the state extending along the carriage bar 139.

The tenser carriage and the package carriage are of the same construction as above except that attachments (not shown) for supporting tensers 153 or packages P are provided in the carriage bar in place of the chucks 140 of the pirn carriage 128. The rails 114, 115 and 116 are each provided with a driving device such as a motor and etc. (not shown) for rotating rollers (which are same as the roller 47 shown in the first embodiment) which hold the side faces of the carriage bar 139 to let the carriage bar to travel. In the other divided positions than the central divided position of the carriage bar 139 there are provided coupling members (not shown) for coupling the divided sections fixedly while permitting only bending in the horizontal direction.

The operation of this embodiment will be described below. For changing the feed yarn in the double twister 101, first the tenser carriage moves out of its stand-by station 106, passes through the branch path 111, advances to the double twister 101 and enters the vertically movable rail 115 of the twister. With descent of the rail 115, the tenser carriage holds the tensers 153 and returns to the stand-by station 106. Next, the pirn carriage 128 in an unloaded state travels from the stand-by station 107 up to the vertically movable rail 115 of the double twister 101 through the branch path 112, then with descent of the rail 115, the chucks 140 hold empty pirns, and with subsequent ascent of the rail 115, the pirn carriage shifts to the fixed rail 114 and advances toward the pirn winder 102.

Simultaneously with or prior to the carrying-out of the empty pirns, the pirn carriage 128 in an unloaded state receives full-loaded pirns 131 from the pirn winder 102. In this case, as shown in FIG. 8*b*, when a front-half carriage bar 139A has entered the vertically movable rail 116, it stops, and with descent thereof, the connecting rods 146 and 147 of the coupling means 141 are disengaged from each other, thus causing separation from a rear carriage bar 139B. Then, the upper pirns 131 loaded on the spindles 130 are held by the chucks 140 and in this way the pirn carriage receives the pirns 131 by a number corresponding to half (½ $n_2$) of the number of spindles in the double twister 101. Jointing is performed when the vertically movable rail 116 rises up to the same level as the fixed rail 114. In this state the rear carriage bar 139B travels into the rail 116. At the same time, the lower pirns 131 are lifted up to the upper end position of the spindles 130, and carriage bar separation is made with subsequent descent of the vertically movable rail 116. The pirns 131 corresponding to the remaining number of spindles (½ $n_2$) are removed while being held by the chucks 140 of the separated rear carriage bar 139B. Upon coincidence of the rail 116 with the level of the fixed rail 114, the connecting rods 146 and 147 assume a jointed state and the front and rear portions together advance toward the double twister 101. Upon arrival at the position of the machine frame 104, the full-loaded pirns 131 corresponding to all the spindles ($n_2$) are supplied simultaneously with descent of the vertically movable rail 115. Then, the pirn carriage now in an unloaded state returns to the stand-by station 107.

In the same manner as in the reception of full-loaded pirns 131, with ascent of the vertically movable rail 116, the pirn carriage 128 holding empty pirns cause the empty pirn of the front and rear portions to be loaded onto all the spindles 130 successively. Then, by means of the tenser carriage, the tensers 153 are attached to the full-loaded pirns which have newly been carried in the double twister 101, and the operation of the double twister 101 is restarted. The packages P produced by the double twister 101 are doffed by the operator and carried up to the take-up tube changing station 108 through the branch path 113, where they are replaced with empty take-up tubes.

Thus, since the pirn carriage 128 formed and divided correspondingly to the spans $p_1$ and $p_2$ is provided with the coupling means 141 for engagement and disengagement in the vertical direction, the pirns 131 can be simultaneously exchanged automatically in the double twister 101 of the long machine frame 104 and the pirn winder 102 of the short machine frame 105, whereby the filament twisting process can be proceeded smoothly. For example, in the case of a long integral carriage bar conforming to the span $p_2$ of the double twister 101, its vertical movement is obstructed by the boxes 118 and 120 present at both ends of the machine frame in the pirn winder 102, while the occurrence of such inconvenience is prevented in the present invention. Particularly, in the case of a machine frame having two stages of spindles, like the pirn winder 102 in this embodiment, the pirns 131 can be carried in and out in an appropriate manner in combination with the travelling of the pirn carriage. Although in the system of this embodiment bobbins are exchanged between the pirn winder 102 and the double twister 101, the present invention is not limited thereto, but is applicable widely to systems in which bobbins are exchanged between two or more machine frames. In short, the following excellent effects is exhibited by the present invention. Since the conveyance unit is divided in the unit of the shortest span and coupling means for engagement and disengagement is provided at divided end portions, it is possible to smoothly effect a simultaneous exchange of packages between machine frames of different spans. When the conveyance unit is traveled along a guide means such as a rail, a number of driving devices for the conveyance unit, which are provided with the guide means at an appropriate intervals, can be reduced because a plurality of the conveyance units are connected to and traveled at a time. That is, a distance between the driving devices may become long.

A preferred example of a junction between a conveyance rail (fixed rail) and a vertically movable rail will be shown below. According to the package changing system of this embodiment, it is intended to prevent the occurence of a difference in height in a conveyance path having a portion adapted to move vertically. The package changing system is provided with a conveyance rail for the traveling of a conveyance unit which holds packages or the like, a vertically movable rail adapted to receive the conveyance unit therein and move vertically for the exchange of packages, and positioning means disposed in a junction between the vertically movable rail and the conveyance rail and functioning to train the vertically movable rail in a position of at least the same level of the two. According to the above construction, the conveyance unit enters the vertically movable rail from the conveyance rail and performs the package changing operation with vertical movement of the vertically movable rail. When the vertically movable rail returns to the conveyance rail side, the positioning means retains the vertically movable rail in such a manner that the conveyance rail and the vertically movable rail are at the same level. This embodiment will be described below with reference to the accompanying drawings.

First, the entire construction of the bobbin changing system of this embodiment will be described with reference to FIGS. 12 and 14. A conveyance path 203 which connects a double twister 201 for filament and a pirn winder 202 directly with each other is formed in a loop shape along machine frames 204 and 205. Conveyance units travel along the conveyance path 203. As the conveyance units there are used a tenser carriage (not shown) for attachment thereto and detachment therefrom of tensers 208 and for conveyance thereof and a package carriage (not shown) for the conveyance of packages P produced by the double twister 201, in addition to a pirn carriage 207 for the conveyance of empty pirns as bobbins and full-loaded pirns 206. In parallel with the machine frames 204 and 205 there are provided a stand-by station 209 for the tenser carriage, a stand-by station 210 for the empty pirn carriage 207 and a take-up tube changing station 211 for the packages P, and there are formed branch conveyance paths 213, 214, 215 and 216 which connect a common conveyance path 212 on the double twister 201 side with the machine frame 205 and the stations 209, 210, 211.

The common conveyance path 212, which is formed along the machine frame 204 of the double twister 201, comprises conveyance rails 217 and 218 extending outwards from both ends of the machine frame 204 and a vertically movable rail 219 which is movable vertically between the rails 217 and 218. At both ends of the vertically movable rail 219 there are disposed positioning means 220 as a characteristic feature of this embodiment. Wire (steel belt) 221 is attached to the vertically movable rail 219 at appropriate intervals. Rollers 223 and a motor 224 are mounted to an upper frame portion 222 of the machine frame 204. The wire 221 is wound or unwound through a pulley 225 of the motor 224, whereby the vertically movable rail 219 is moved vertically through the rollers 223. An upper end position of that vertical movement is the position for the reception and delivery of the pirn carriage 207, etc. between the conveyance rails 217 and 218, while a lower end position thereof is the position (position Q indicated by a dash-double dot line in FIG. 14) for the exchange of pirns. The machine frame 204 is provided with guides 226 in the vertical direction, which are engaged with guide rollers (not shown) provided on the vertically movable rail 219 side, to guide the vertical movement of the same rail.

Figure 13:
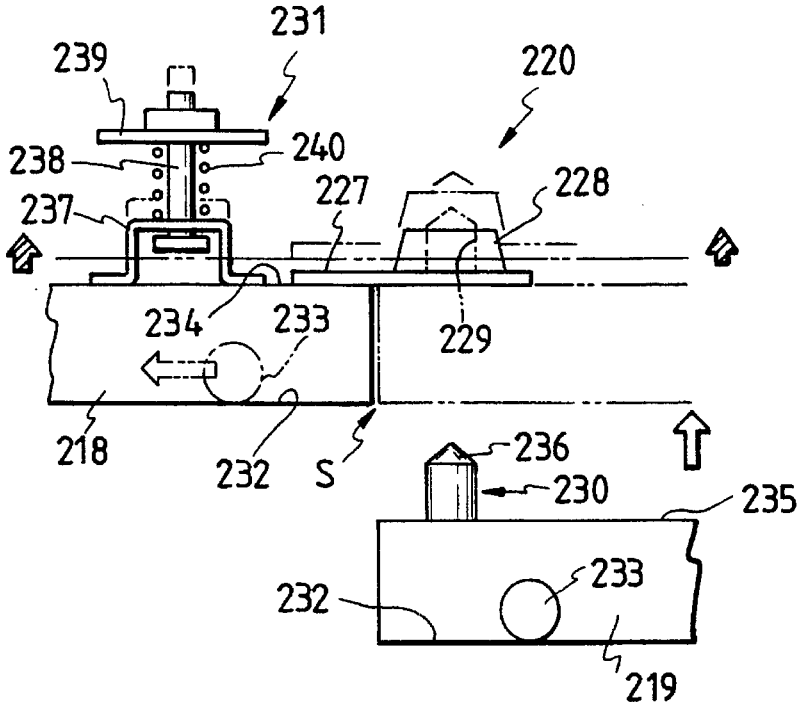
FIG. 13 is a side view showing a bobbin changing system according to a further embodiment of the present invention.
Figure 14:
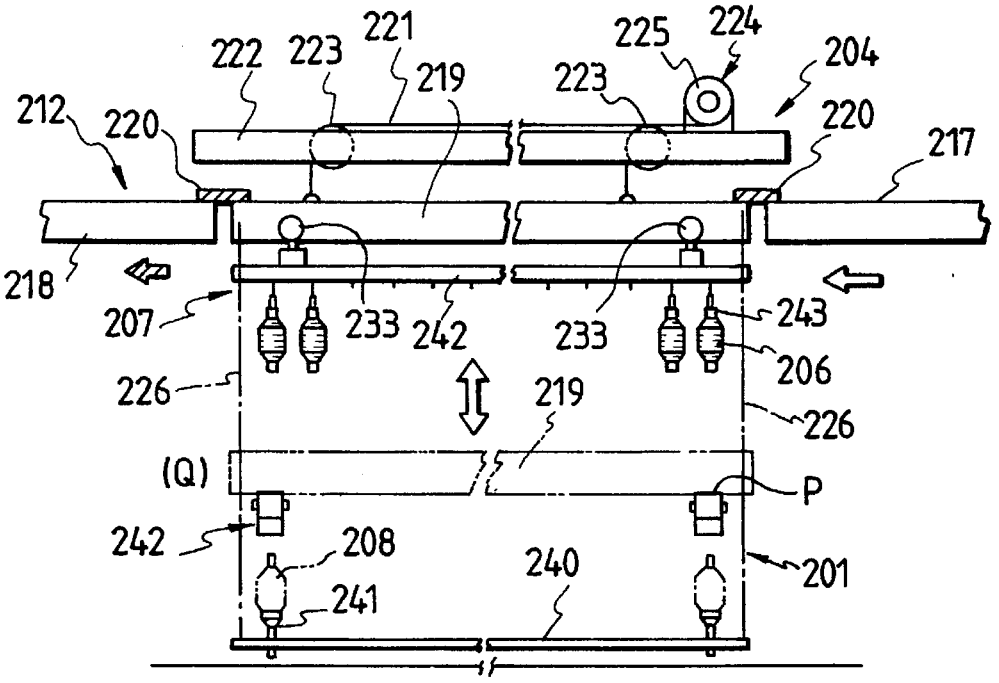
FIG. 14 is a side view showing the whole of FIG. 13.

Since the paired positioning means 220 shown in FIG. 14 are of the same construction, the following description is now provided about the one positioned on the carrying-out side. As shown in FIG. 13, the positioning means 220 comprises a retaining plate 227 provided at an end portion of the conveyance rail 218, a block 228 provided on the retaining plate 227, and a cylindrical protrusion 230 formed on the vertically movable rail 219 and which is-fitted into a circular hole 229 formed in both retaining plate 220 and block 228. A movable support member 231 is provided at the end portion of the rail 218. The conveyance rail and the vertically movable rail 219 are formed by cutting a long molded aluminum member and are of the same, substantially square sectional shape equal in height and width. Lower-end inner wall surfaces 232 of the rails 218 and 219 serve as traveling surfaces for traveling wheels 233 of the pirn carriage 207, etc. The retaining plate 227 is mounted on one end side thereof to an upper surface 234 of the conveyance rail 218, while the opposite end side thereof extends horizontally to the vertically movable rail 219 side so that it comes into abutment with an end portion of an upper surface 235 of the rail 219 in a raised position. The block 228 is mounted to the upper surface of the opposite end side of the retaining plate 227 and is positioned so as to give a minimum gap, s, between the conveyance rail 218 and the vertically movable rail 219 when the protrusion 230 is fitted in the circular hole 229. The protrusion 230 is erected on the upper surface of an end portion of the rail 219 and has a sharp tip 236. As the protrusion 230 approaches the hole 229, it comes into sliding contact with the lower-end marginal portion of the hole and is thereby guided to a coaxial position.

The movable support member 231 is provided with a rod 238 mounted to the upper surface 234 of the conveyance rail 218 through a bracket 237. The upper end of the rod 238 is inserted for protrusion and retraction into a hole of a guide plate 239 attached to a machine frame portion (not shown). A spring 240 disposed around the rod 238 is held between the guide plate 239 and the bracket 237 to urge the end portion of the conveyance rail 218 downward. The vertically movable rail 219 is raised up to a position slightly higher than the position of the conveyance rail 218 which is in a pressed state by the spring 240, whereby the lower surface of the retaining plate 227 and the upper surface 235 of the vertically movable rail 219 are brought into close contact with each other. In connection with the movable support member 231, there may be adopted a construction wherein the rod 238 is fixed to the guide plate 239, a hole for insertion therethrough of the rod 238 is formed in the bracket 237 to guide an upward movement of the rod in abutment with the hole, and a flange formed at the lower end of the inserted rod 238 is brought into engagement with the bracket 237 to determine a lower-limit position of the end portion of the rail 218. Other support members to be mounted to the conveyance rail 218 at suitable intervals may be of the conventional fixed structure.

In the double twister 201, the spindles arranged in parallel in a large number are each provided with a spindle 241 which is rotated simultaneously with the other spindles by means of a driving belt 240 and a winder 242 for taking up yarn (filament) which has been twisted by the spindle 241. The pirn carraige 207 is composed of a carriage bar having a length corresponding to the vertically movable rail 219 and chucks 243 mounted in the positions corresponding to the spindles of the carriage bar 242. Mounted on the carriage bar 242 are traveling wheels 233, which travel in one direction under a rotative driving force of a motor (not shown). The chucks 243 operate upon insertion thereof into the core tubes of the full-loaded pirns 206 or empty pirns to chuck or release the pirns. The carriage bar 242 is divided appropriately in the longitudinal direction so that it can curve along curved portions of the conveyance path 203. The tenser carriage and the package carriage each comprise a similar carriage bar 242 having attachments (not shown) for supporting the tensers 208 or the packages P instead of the chucks 243.

The operation of this embodiment will be described below.

When the feed yarn (filament) in the double twister 201 has been consumed and there arises the necessity of changing pirns, first the tenser carriage moves out of its stand-by station 209, passes through the branch conveyance path 214 and advances toward the double twister 201. Upon entering thereof into the vertically movable rail 219, the rail 219 goes down and the tenser chucks hold the tensers 208, then remove them from empty pirns with ascent of the rail 219. Both ends of the raised rail 219 come into abutment with the retaining plate 227 and are kept at the same level as the conveyance rails 217 and 218. At the same time, the protrusion 230 is fitted in the circular hole 229 of the block 228, whereby the positioning in the transverse direction and that in the direction perpendicular to the paper surface are performed at a time. In this state, the tenser carriage shifts to the conveyance rail 218 on the carrying-out side from the vertically movable rail 219 and returns to the stand-by station 209. Subsequently, the pirn carriage 207 in an unloaded state moves out of its stand-by station 210, passes through the branch conveyance path 215 and travels up to the vertically movable rail 219. With ascent of the rail 219, the chucks 243 hold empty pirns and the pirn carriage advances toward the pirn winder 202. Next, the full-loaded pirns 206 from the pirn winder 202 are carried in from another pirn carriage 207, and the pirn carriage 207 which has thus become empty travels up to the stand-by station 210. By means of the tenser carriage 209, the tensers 208 are attached to the full-loaded pirns 206 which has newly been carried in, and the operation of the double twister 201 is re-started. The packages P produced by the double twister 201 are doffed by the operation and are then conveyed up to the take-up tube changing station 211 through the branch conveyance path 216 by means of the package carriage, followed by replacement with empty take-up tubes.

Thus, since the retaining plates 227 are provided at end portions of the conveyance rails 217 and 218, allowing the vertically movable rail 219 to come into abutment with the retaining plates in the course of upward movement of the rail 219 and thereby retaining the rail 219 at the same level as the rails 217 and 218, it is possible to eliminate a difference in height at the seams of the traveling surfaces and hence the pirn carriage, etc. can travel smoothly without causing any harmful vibration. Further, since the end portions of the conveyance rails 217 and 218 are each supported in a downwardly urged state by the movable support member 231 and the vertically movable rail 219 is stopped in a rather high position, the abutted state of the rail 219 with the retaining plate 227 is maintained and the rail 219 is sure to be held at the same level as the conveyance rails 217 and 218.

In this embodiment, moreover, since the protrusion 230 is formed at each end portion of the vertically movable rail 219 and it is fitted in the circular hole 229 of the block 228 upon abutment of the rail 219 with the retaining plate 227, the rail 219 is restrained in the radial direction of the protrusion 230, so it is possible to set the gap, s, between the rail 219 and the conveyance rail 217 (218) to a minimum required value even in the event there occurs a displacement due to play of the vertical movement guiding rollers.

In the case where molded products of different heights are used as a conveyance rail and a vertically movable rail, respectively, even if their upper surfaces are brought into the same level using the retaining plate, their traveling surface levels are not coincident with each other. In such a case, in view of the difference in height, the retaining plate, for example, may be formed in a stepped shape so that the traveling surface levels of both rails are coincident with each other upon abutment of the vertically movable rail with the retaining plate. The retaining plate and the protrusion may be provided on the lower surface side if the traveling of the conveyance unit is not obstructed thereby.

Although the system for changing packages between the pirn winder and the double twister has been shown above in this embodiment, the present invention is not limited thereto, but is applicable widely to other package changing systems.

The following excellent effect is attained by this embodiment.

Since the positioning means for retaining the vertically movable rail is disposed at the junction between the vertically movable rail and each conveyance rail, it is possible to eliminate a difference in height between the rails in a raised position of the vertically movable rail, whereby the exchange of packages can be attained under smooth traveling of the conveyance unit.

An example in which a guide for guiding the vertical movement of a vertically movable rail is separated up and down will now be shown. An outline thereof will be described below with reference to FIGS. 17, 18 and 19.

Figure 17:
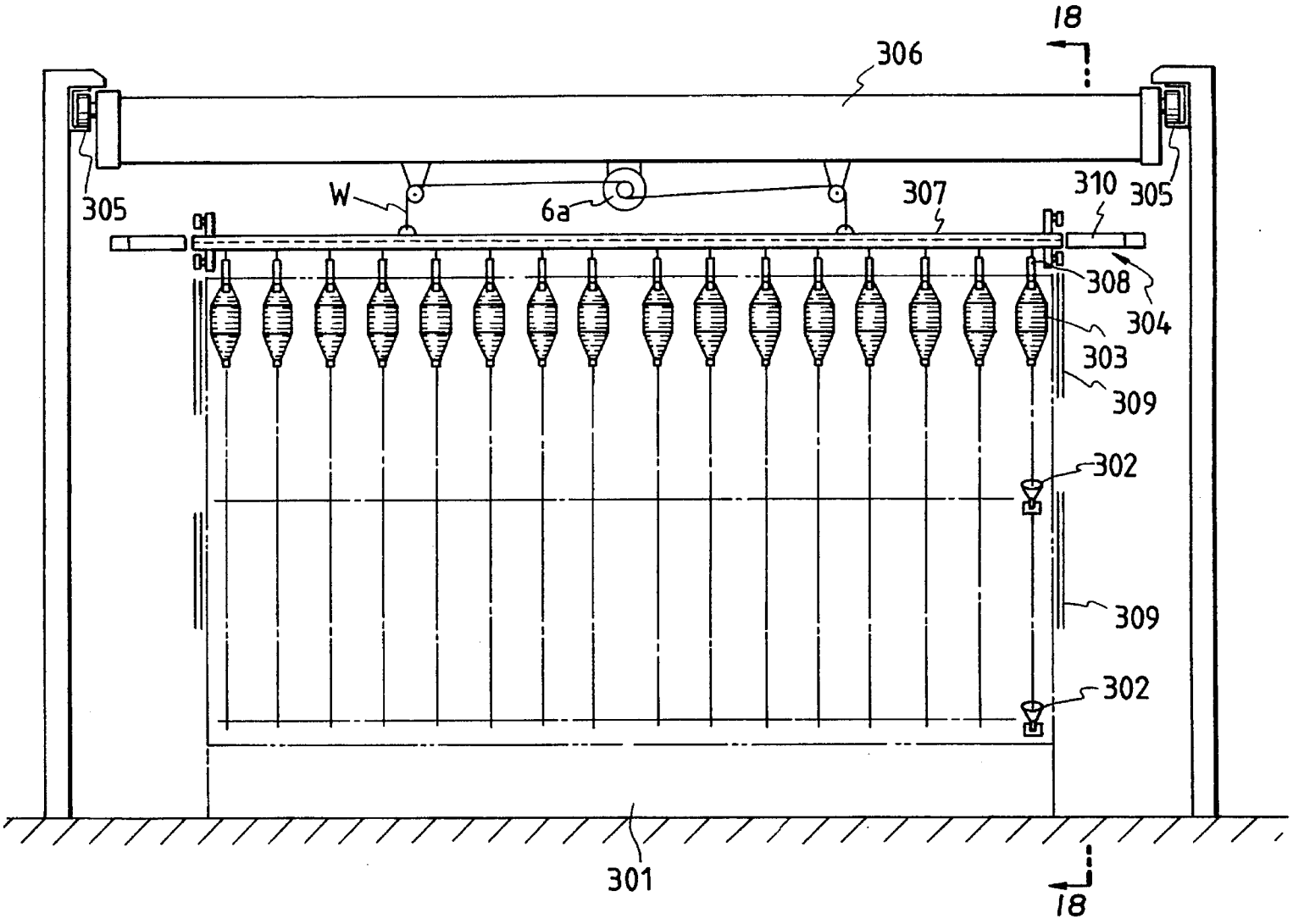
FIG. 17 is a front view showing a machine frame and the bobbin changing system.
Figure 18:
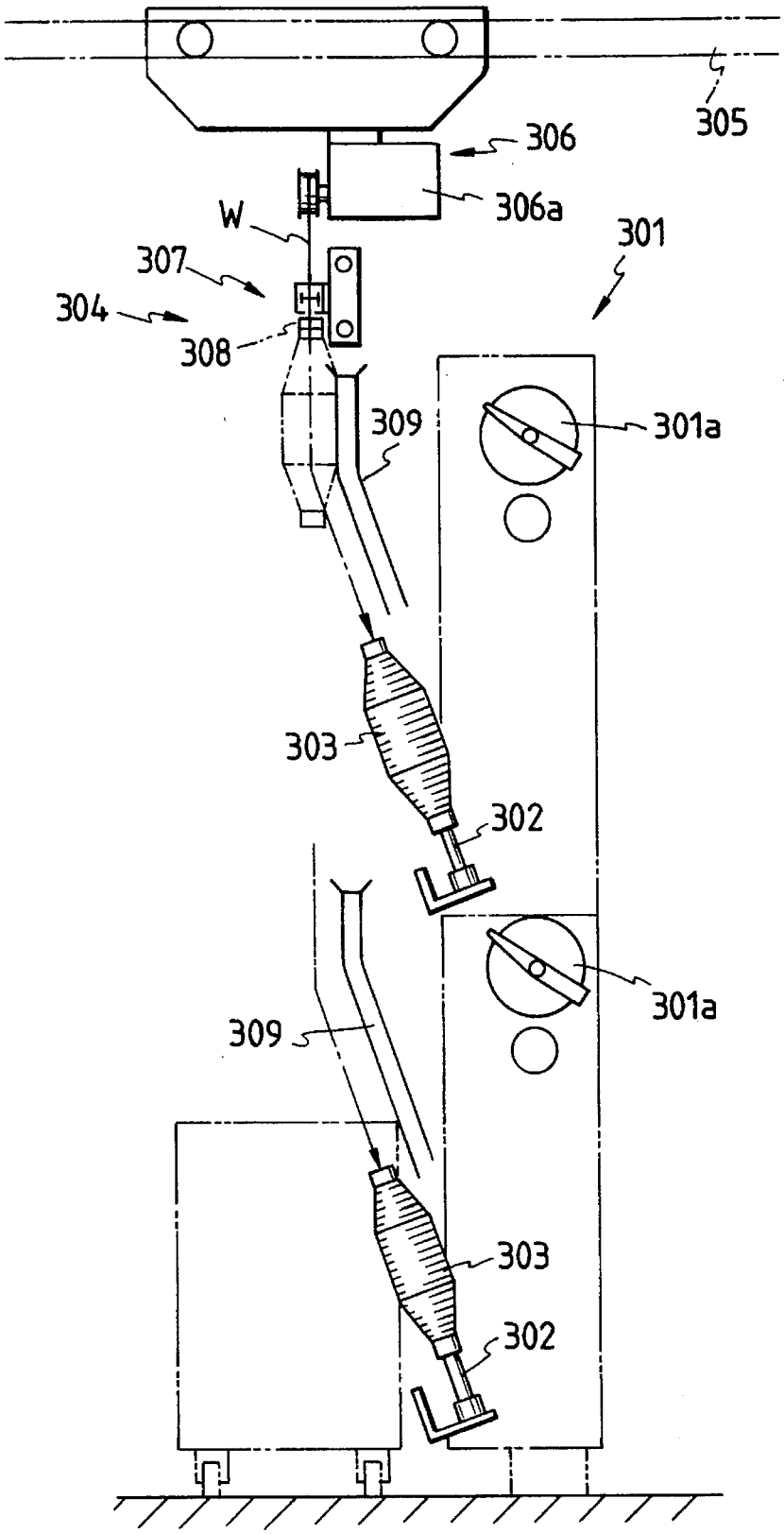
FIG. 18 is a side view taken on line A—A in FIG. 17, showing the machine frame and the bobbin changing system.

As illustrated in FIGS. 17 and 18, the numeral 301 denotes a machine frame of a double twister for filament. The machine frame 301 has spindles 302 arranged in two vertical stages and in a large number transversely. Packages 303 are fed to the spindles 302.

For example, when a full-loaded package 303 is fed to a spindle 302, the spindle 302 is stoop up into an upright posture from its obliquely upwardly inclined position indicated by a solid line in FIG. 18, then the filament yarn on the full-loaded package is twisted and taken up by a winder 301*a*. The package 303 which has thus become empty is tilted again to the position indicated by a solid line in the figure and is replaced with the full-loaded package 303.

To this end, a package changing system 304 is attached to the machine frame 301 for pulling out empty packages 303 from the spindles 302, supplying full-loaded packages (shown in the figure) to the spindles 302 and exchanging empty and full-loaded packages with each other.

The package changing system 304 consists mainly of chuck means 308 for chucking packages 303 and two guide rails 309 for guiding the vertical movement of a vertically movable rail 307 which holds the chuck means 308, the guide rails 309 being separately provided up and down. The vertically movable rail 307 is suspended from an overhead traveling crane 306 through wire W. As the wire W is unwound or wound by means of a winder 306*a*, the vertically movable rail 307 is moved vertically along the guide rails, whereby the full-loaded packages 303 held by the chuck means 308 can be loaded onto the spindles 302 or empty packages 303 can be chucked and taken out from the spindles 302 for the exchange of packages.

Although the details are here omitted, the chuck means 308 for holding the packages 303 are movable along the vertically movable rail 307, so that when the rail 307 is in its raised and jointed position with respect to a conveyance rail 310, the same number of full-loaded packages 303 as that of the spindles 302 are carried into the vertically movable rail 307 from the conveyance rail 310, or empty packages 303 from the rail 307 are carried out through the rail 310. The overhead traveling crane 306 can move along a traveling rail 305, thereby permitting the exchange of packages in a plurality of machine frames 301 located in another place.

Figure 19:
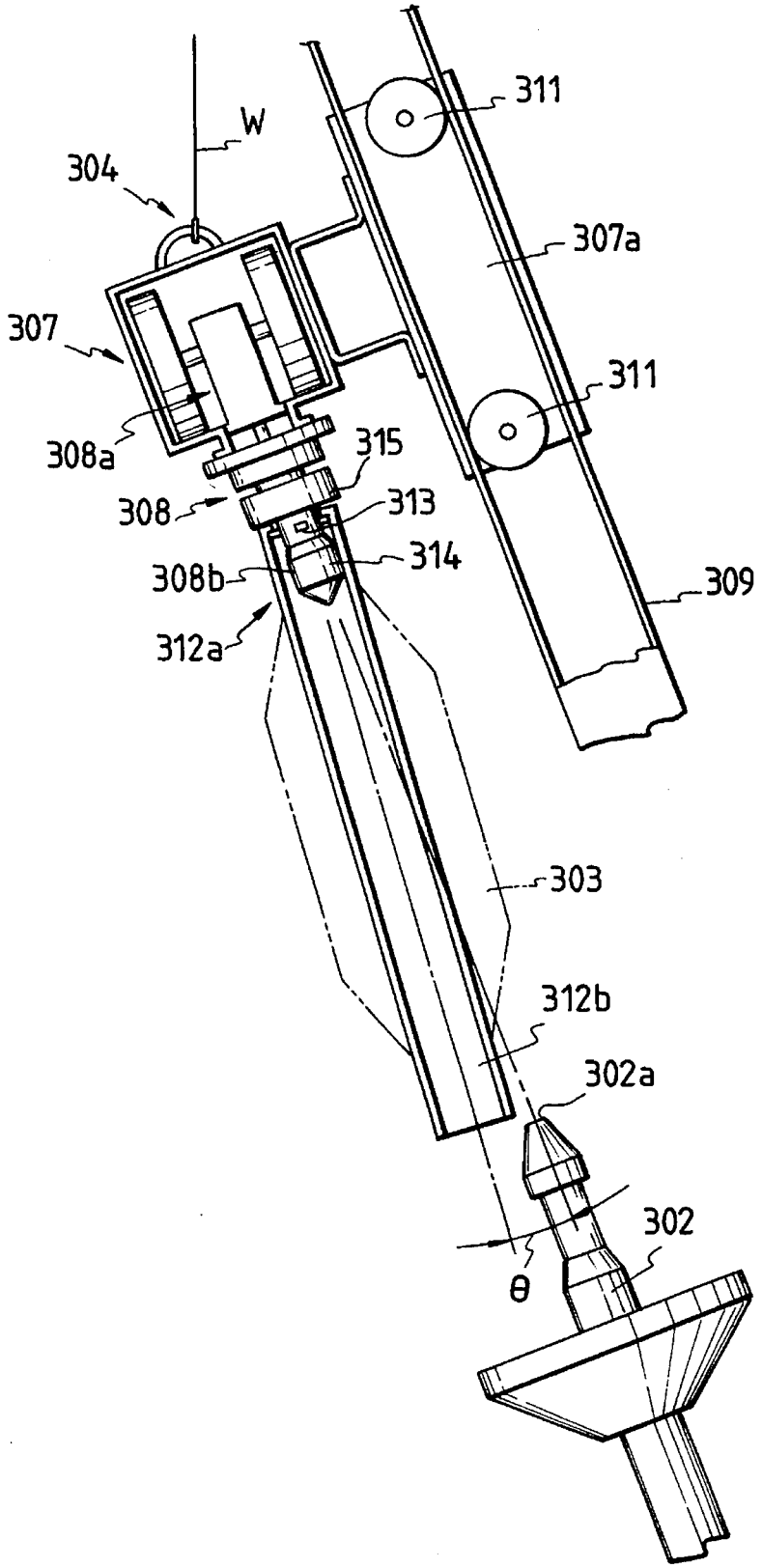
FIG. 19 is a sectional side view showing the details of a bobbin changing system before improvement.

FIG. 19 illustrates the details of the package changing system 304. As mentioned above, the rail 307 is movable vertically along the guide rails 309. More specifically, roller members 311 provided on a roller base 307*a* of the vertically movable rail 307 are adapted to roll through the guide rails 309, whereby the rail 307 is guided along the guide rails.

In exchanging packages 303, the spindles 302 are each tilted forward as illustrated in the figure, and the guide rails 309 are formed so as to become parallel with the tilted spindle 302.

The chuck means 308 each comprise a traveling portion 308*a* adapted to travel within the vertically movable rail 307 and an insert member 314 provided below the traveling portion 308*a* so as to project from the rail 307, the insert member 314 having retractably protrudable pawls 313. When the insert member 314 is inserted into the package 303, the pawls 313 protrude to hold the package 303. The package 303 is formed with a convex portion 315 for preventing dislodgement of the pawls 313.

As shown in FIG. 19, the chuck means 308 merely hold the upper end of the package 303, so there is no problem in taking out an empty package 303, but at the time of loading a full-loaded package onto the spindle, there arises a problem such that oscillation θ occurs with an upper end 312*a* as a base point due to its own weight. Consequently, a lower end 312*b* of the package and a tip end 302*a* of the spindle 302 are displaced from each other, thus making it impossible to fit the lower end 312*b* onto the spindle 302.

The following description is now provided about a package changing system embodying the invention and which can solve the above-mentioned problem and permits a smooth supply of full-loaded packages.

The package changing system of this embodiment is provided with chuck means for holding packages, guide means for guiding vertical movements of the chuck means to exchange empty packages and full-loaded packages with respect to obliquely upwardly projecting spindles, and tilling means for tilting the chuck means to align the full-loaded packages and the spindles with each other at the time of loading the full-loaded packages onto the spindles.

According to the above construction, before the lower end portion of each full-loaded package is fitted on the tip end portion of the associated spindle, the lower end of the full-loaded package is slightly tilted upward so as to offset the oscillation induced by the own weight of the full-loaded package, by the tilting means, whereby the full-loaded package and the spindle can be aligned with each other and hence the supply of full-loaded package can be effected smoothly.

The package changing system of this embodiment will be described below in detail with reference to the accompanying drawings.

As explained above in connection with FIGS. 17 and 18, the numeral 301 denotes a machine frame of a double twister for filament. The machine frame 301 has spindles 302 arranged in two vertical stages and in a large number in the transverse direction. In exchanging packages, as explained previously, the spindles 302 tilt forward (leftward in the figure) which side is a take-out or supply side, and thus project obliquely upward. On the other hand, a package changing system 304 for exchanging empty and full-loaded packages with respect to the spindles 302 is attached to the machine frame 301. The construction of the package changing system 304 will be described below in detail.

In the machine frame 1 (see FIGS. 17 and 18), there are provided guide rails 309 as guide means A so as to sandwich the machine frame laterally from both sides. The guide rails 309 are formed to have a -shaped section, with the open portions facing toward the machine frame. The guide rails 309 are provided in two stages up and down correspondingly to the upper and lower stages of the spindles 302 and are each extended downward from above the machine frame 301 to the position of the spindle 302 while being bent in an intermediate position so as to become parallel to the tilting direction of the spindle in a position near the spindle.

There is provided a vertically movable rail 307 extending between the guide rails 309 and adapted to move vertically while being guided by the guide rails. The vertically movable rails 307 is provided with chuck means 308.

Figure 15:
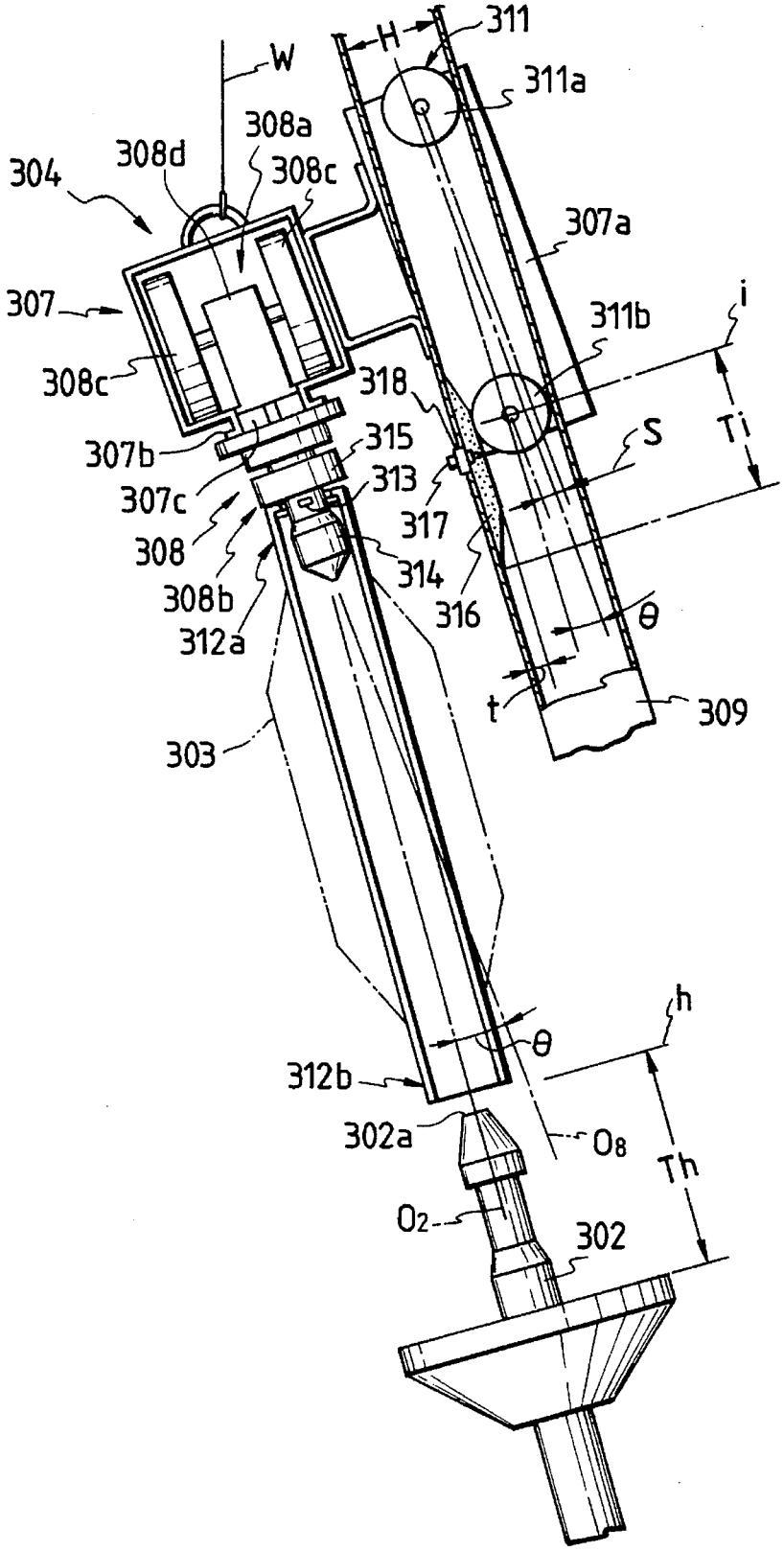
FIG. 15 is a sectional side view showing a bobbin changing system according to a still further embodiment of the present invention.

As shown in FIG. 15, the vertically movable rail 307 is formed substantially in a square shape in section, having a slit 307*c* in the lower portion. A restriction piece 307*b* for restricting vertical movements of the chuck means 308 which are supported by the rail 307 is formed projectingly from the lower portion of the rail 307. The vertically movable rail 307 is provided with a roller base 307*a* projecting on the rear side as the guide rail 309 side and roller members 311 journaled on the roller base 307*a* and adapted to roll through the guide rails 309. As the roller members 311, an upper roller member 311*a* and a lower roller member 311*b* are disposed diagonally in the upper and lower portions, respectively, of the roller base 307*a*. The upper roller 311*a* rolls in abutment with the inside rear portion of each guide rail 309, while the lower roller member 311*b* rolls in abutment with the inside front portion of the guide rail. The upper and lower roller members 311*a*, 311*b* are formed to have an outside diameter smaller than the width H of the guide rail and in such a manner that their axes are spaced from each other by an offset S back and forth. The roller base 307*a* tilts, following tilt of the guide rail 309.

Wire W is attached to the upper portion of the vertically movable rail 307, and by unwinding or winding the wire W, using the winder 306*a* shown in FIGS. 17 and 18, the rail 307 is moved vertically while being guided by the guide rails 309.

The chuck means 308 are each mainly composed of a traveling portion 308*a* accommodated with the vertically movable rail 307 and a chuck portion 308*b* which holds a package 303 releasably. The traveling portion 308*a* comprises wheels 308*c*, 308*c* adapted to roll in abutment with the inside bottom of the rail 307 and a wheel base 308*d* which supports the wheels 308*c*, 308*c* through a shaft. The lower end portion of the wheel base 308*d* is fitted in the slit 307*c* and is slidable along the slit. After entering the vertically movable rail 307, the traveling portion 308*a* is locked and fixed by a suitable means. The chuck portion 308*b* is supported by the wheel base 308*d* and it holds the restriction piece 307*b* slidably between it and the wheels 308*c*. Consequently, when the vertically movable rail 307 tilts, the chuck portion 308*b* also tilts integrally with the rail 307 without displacement. The chuck portion 308*b* comprises an insert member 314 which is inserted into an upper end portion 312*a* of the package 303 and a plurality of pawls 313 provided for protrusion and retraction in the insert member 314 and which support the upper end portion 312*a* of the package 303 from the inside. The insert member 314 has a maximum diameter which permits fitting thereon of a convex portion 315 which is formed inside the upper end of the package 303, and its lower end is tapered to facilitate the insertion thereof into the package. When the insert member 314 is inserted into the upper end portion 312*a* of the package 303 and the pawls 313 are opened by pawl opening/closing means (not shown), the pawls 313 press and hold the inside of the package 303 and at the same time they come into engagement with the convex portion 315, thereby allowing the package 303 to be suspended and supported.

In this embodiment, as mentioned above, there occurs oscillation θ of the full-loaded package 303 when chucked by the chuck means 308. To offset this and align the full-loaded package 303 with the spindle 302, there is provided a tilting means B for slightly tilting the lower end of the full-loaded package 303 upward.

Figure 16:
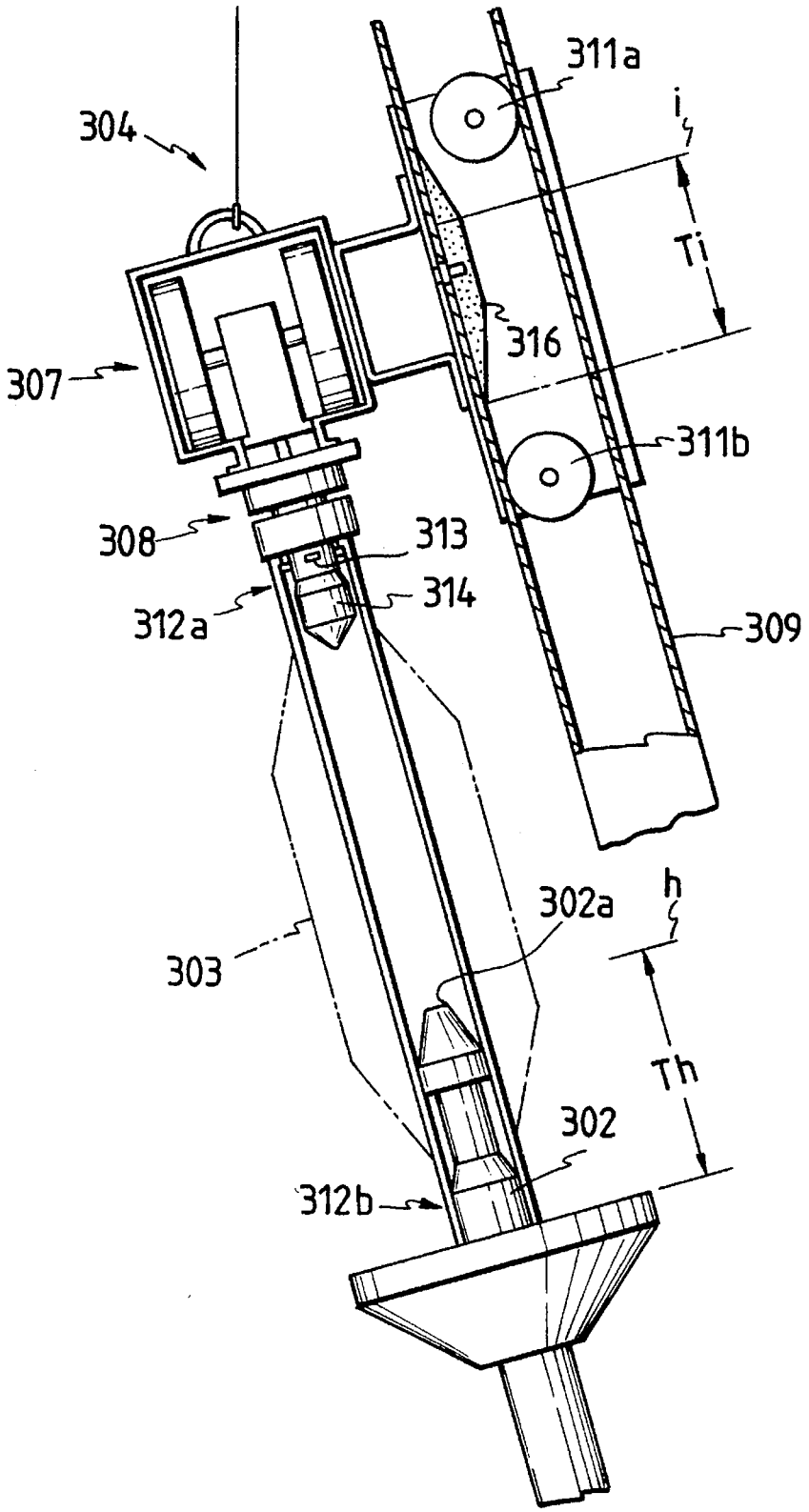
FIG. 16 is a sectional side view showing a loaded state of a full-loaded bobbin onto a spindle.

The tilting means B is constituted by a cam 316 provided in the guide rail 309. The cam 316 is formed in a trapezoidal shape having a predetermined thickness, t, and is fixed with bolt 317 to an inside front part of the guide rail 309. In this case, since the bolt 317 is inserted into an elongated insertion hole 318 formed in the guide rail 309 to fix the cam 316, the position of the cam is slightly adjustable vertically. The cam 316 is disposed in the position, i, which the lower roller member 311*b* assumes when a lower end portion 312*b* of the package 303 arrives at the position, h, of an upper end portion 302*a* of the spindle 302. At this time, the lower roller member 311*b* mounts on the cam 316 completely. A longitudinal length $T_i$ of the cam 316 is set as $T_i<T_h$ so that the lower roller member 311*b* comes down from the cam completely as shown in FIG. 16 when the lower end portion 312*b* of the package 303 goes down by $T_h$ from the position, h, of the upper end portion 302*a* of the spindle 302 and the package 303 is fitted on the spindle 302 completely.

Thus, the outside diameter of the lower roller member 311*b* is set to a value smaller than (H - t) so that the lower roller member can roll even on the cam 316.

Further, since the same number of chuck means 308 as that of the spindles 302 are supported by the vertically movable rail 307, the exchange of packages is performed simultaneously for all of the spindles 302 on the upper or lower stage as the vertically movable rail 307 moves vertically.

The operation of this embodiment will be described below.

For supplying the full-loaded package 303 to the spindle 302, as shown in FIG. 15, when the full-loaded package 303 held by the chuck means 308 is guided by the guide rail 309 which is parallel to the spindle 302, the chuck means 308 is further tilted by the tilting means B to offset the foregoing oscillation θ of the full-loaded package 303 caused by the own weight of the bobbin, whereby the full-loaded package 303 can be aligned with the spindle 302. More particularly, with descent of the full-loaded package 303 while being held by the chuck means 308, the lower roller member 311*b* passes a certain position, i, of the cam 316, and with further descent of the full-loaded package, the lower roller member 311*b* mounts on the cam completely, whereupon the axis $O_8$ of the chuck means 308 is further inclined by θ with respect to the axis $O_2$ of the spindle 302. In this way it is possible to make alignment between the full-loaded package 303 and the spindle 302.

As the full-loaded package 303 further goes downs the lower roller member 311*b* comes down completely from the cam 316 and the full-loaded package is fitted on the spindle 302, as shown in FIG. 16. Thereafter, the pawls 313 are closed and the chuck means 308 are moved upward, whereby the supply of the full-loaded package 303 is completed.

In pulling out an empty package 303 from the spindle 302 before the supply of the full-loaded package 303, as shown in FIG. 16, the vertically movable rail 307 is brought down, allowing the insert member 314 of the chuck means 308 to be inserted into the empty package 303, then the pawls 313 are opened and the rail 307 is again moved upward, whereby the empty package 303 is pulled out from the spindle 302 and rises. The removal of the empty package is now over.

At this time, since the tip end of the insert member 314 is positioned at the upper end of the empty package 303 after the lower roller member 311*b* has come down from the cam 316, the empty package and the insert member are again aligned with each other without displacement, thus permitting the insert member 314 to be inserted into the upper end portion 312*a* of the empty package 303.

Although in this embodiment the cam 316 is provided in an inside front part of the guide rail 309 to serve as the tilting means B and the lower roller member 311*b* mounts thereon to tilt the package 303, there may be adopted a construction wherein the cam 316 is provided in an inside rear part of the guide rail 309 to serve as the tilting means B and the upper roller member 311*a* mounts thereon. Further, since what is required is to change the inclination of the full-loaded package 303 so that the lower end portion 312*b* of the empty package 303 can be fitted on the upper end portion 302*a* of the spindle 302, there also may be adopted a construction wherein roller member 311 are formed so as to hold the guide rail 309 therebetween from the outside in front and in the rear, and a recess is formed in the guide rail 309 to serve as the tilting means B.

This embodiment of the present invention exhibits the following excellent effect.

Particularly, the supply of full-loaded packages can be fone smoothly and it is possible to improve the package changing efficiency.

What is claimed is:

1. A package changing system having:

a first rail vertically movable parallel with a plurality of horizontal rows of spindles for which empty packages and full-loaded packages are to be replaced with each other;

a second rail connected to said first rail in a raised position of said first rail; and a conveyance unit for travel along said second rail having means for changing packages and for entering and leaving said first rail.

2. A package changing system as claimed in claim 1, wherein said second rail includes a plurality of standby rails for holding plural said conveyance units for different articles separately so that the conveyance units can enter and leave said standby rails.

3. A package changing system as claimed in claim 1, wherein said first rail is provided vertically movably in parallel with the arranged direction of spindles arranged in rows and in two or more vertical stages and for which empty packages and full-loaded packages are to be replaced with each other; and said first rail is vertically movable selectively for each of the vertical stages.

4. A package changing system as claimed in claim 11, wherein said first rail is provided with an elongated hollow square member having a slit bottom and said conveyance unit comprises a base plate, rollers being provided rotatably on the upper side of the base plate, and a plurality of chucks projectingly provided on the lower side of the base plate, said rollers being traveled within said elongated hollow, square member of the first rail.

5. A package changing system as claimed in claim 1, wherein said conveyance unit has a conveyance unit for changing a plurality of packages at a time through vertical movement of said first rail while traveling between frames having different spans, said conveyance unit, formed for conformity with the longest of said different spans, being divided at least in the length of the shortest of said different spans, and coupling means for coupling and uncoupling said divided conveyance unit.

6. A package changing system as claimed in claim 5, wherein said coupling means comprises bases which are mounted to the divided end portions and a pair of connecting rods which are disposed above and in parallel with the bases being pivotally supported by vertical pins implanted in the bases at the base ends of the connecting rods, and are positioned in such a manner that the respective distal ends are opposed to each other, to the distal end of one of said connecting rod being attached an elliptic ball-like joint member, while in the distal end of said other connecting rod being formed a joint hole for enclosing and grasping the elliptic ball-like joint member in the horizontal direction.

7. A package changing system as claimed in claim 1 wherein said first rail is vertically movable for receiving a conveyance unit therein and moving vertically for change of packages;

said second rail is a conveyance unit which holds packages and positioning means disposed in a connection between said vertically movable first rail and said conveyance rail for retaining said vertically movable rail in a position in which both said rails are at least at the same level.

8. A package changing system as claimed in claim 7, wherein said positioning means comprises a retaining plate provided at an end portion of the conveyance rail, a block provided on the retaining plate a circular hole being formed in both said retaining plate and said block, and a cylindrical protrusion formed on the vertically movable rail and which is fitted into the circular hole.

9. A package changing system as claimed in claim 8, wherein a movable support member for supporting the conveyance rail in a downwardly urged state is provided at the end portion of the conveyance rail.

10. A package changing system as claimed in claim 1, wherein said package changing system includes;

guide means for guiding vertical movements of a chuck means for engaging, obliquely upwardly, projecting mounting members of a package for changing empty and full-loaded packages; and tilting means for tilting said chuck means to align said chuck means with said mounting member of full-loaded packages at the time of loading said full-loaded packages onto said mounting members.

11. A package changing system as claimed in claim 1, having a guide means for guiding said first rail from said connection with said second rail to a position for putting a package on said machine frame.

* * * * *